US008773483B2

(12) United States Patent
Ando et al.

(10) Patent No.: US 8,773,483 B2
(45) Date of Patent: Jul. 8, 2014

(54) DUPLEX PRINTING METHOD, BOOKBINDING METHOD, PRINTER FOR USE IN DUPLEX PRINTING METHOD

(75) Inventors: Jitsuhiko Ando, Saitama (JP); Taketo Nozu, Tokyo (JP); Tsuyoshi Katsuta, Atsugi (JP); Takamasa Akagawa, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 376 days.

(21) Appl. No.: 13/126,382

(22) PCT Filed: Nov. 13, 2009

(86) PCT No.: PCT/JP2009/069394

§ 371 (c)(1), (2), (4) Date: May 25, 2011

(87) PCT Pub. No.: WO2010/055923

PCT Pub. Date: May 20, 2010

(65) Prior Publication Data

US 2011/0221855 A1 Sep. 15, 2011

(30) Foreign Application Priority Data

Nov. 14, 2008 (JP) ..... 2008-292551
Nov. 14, 2008 (JP) ..... 2008-292566
Jan. 19, 2009 (JP) ..... 2009-008485

(51) Int. Cl.
*B41J 3/60* (2006.01)

(52) U.S. Cl.
CPC ..... *B41J 3/60* (2013.01)
USPC ..... 347/171

(58) Field of Classification Search
USPC ..... 347/171, 218, 172, 174, 176; 400/82, 400/188
See application file for complete search history.

(56) References Cited

U.S. PATENT DOCUMENTS 4,751,519 A * 6/1988 Shimada et al. ..... 347/218
4,962,386 A 10/1990 Hakkaku et al.

(Continued)

FOREIGN PATENT DOCUMENTS

JP A-01-299076 12/1989
JP U-03-055253 5/1991

(Continued)

OTHER PUBLICATIONS

Machine-generated translation of JP 06-270482, published on Sep. 1994.*

(Continued)

*Primary Examiner* — Huan Tran
(74) *Attorney, Agent, or Firm* — Oliff PLC

(57) ABSTRACT

A method for printing on both sides of a roll sheet including superimposing and pressing a thermal transfer sheet and the roll sheet between a platen roller and a thermal head so that the bottom surface of the thermal transfer sheet touches the top surface of the roll sheet and the bottom surface of the roll sheet touches the platen roller, and printing an image on the top surface of the roll sheet while conveying the sheets; and superimposing and pressing a thermal transfer sheet and the roll sheet between a platen roller and a thermal head so that the top surface of the thermal transfer sheet touches the bottom surface of the roll sheet and the top surface of the roll sheet touches the platen roller, and printing an image on the bottom surface of the roll sheet while conveying the sheets.

39 Claims, 19 Drawing Sheets

(56) References Cited

U.S. PATENT DOCUMENTS

| | | | | |
|---|---|---|---|---|
| 4,990,933 | A * | 2/1991 | Hatakeyama et al. | 347/174 |
| 5,296,874 | A * | 3/1994 | Nagata et al. | 347/218 |
| 6,077,016 | A | 6/2000 | Geiser et al. | |

FOREIGN PATENT DOCUMENTS

| | | |
|---|---|---|
| JP | A-04-067976 | 3/1992 |
| JP | A-05-185668 | 7/1993 |
| JP | A-06-270482 | 9/1994 |
| JP | A-09-193430 | 7/1997 |
| JP | A-10-016432 | 1/1998 |
| JP | A-11-001010 | 1/1999 |
| JP | A-11-020278 | 1/1999 |
| JP | A-11-286147 | 10/1999 |
| JP | A-2000-158847 | 6/2000 |
| JP | A-2001-509102 | 7/2001 |
| JP | A-2001-260515 | 9/2001 |
| JP | A-2001-324839 | 11/2001 |
| JP | A-2003-063072 | 3/2003 |
| JP | A-2005-029278 | 2/2005 |
| JP | A-2005-231839 | 9/2005 |
| JP | A-2006-327013 | 12/2006 |
| JP | A-2008-093846 | 4/2008 |

OTHER PUBLICATIONS

Machine-generated translation of JP 2003-063072, published on May 2003.*

Machine-generated translation of JP 2000-158847, published on Jun. 2000.*

International Search Report issued in International Patent Application No. PCT/JP2009/069394 dated Dec. 15, 2009.

International Preliminary Report on Patentability issued in International Patent Application No. PCT/JP2009/069394 dated Jun. 21, 2011.

Dec. 17, 2013 Office Action issued in Japanese Patent Application No. 2009-259592 (with translation).

* cited by examiner

7a(7b) thermal transfer sheet (a)

(b)

DUPLEX PRINTING METHOD, BOOKBINDING METHOD, PRINTER FOR USE IN DUPLEX PRINTING METHOD

TECHNICAL FIELD

The present invention relates to the duplex printing method for printing on both sides of roll sheet by a thermal transfer method, the bookbinding method, and printer for use in duplex printing method.

BACKGROUND ART

Conventionally, as one of the printing methods, the thermal transfer method which presses a thermal transfer sheet to a recording sheet by a thermal head, makes the heat generation element, which is a heat generation part of a thermal head, to generate heat according to the image data to be printed, makes the color material of a thermal transfer sheet to transfer to a recording sheet, and records a image is known.

Also in the printer of such a thermal transfer method, the request of printing on both sides of a recording sheet is increasing, like the usual printer.

As the printer of a thermal transfer method which makes duplex printing possible, in the patent documents 1, the thermal transfer printer which has 1st and 2nd transfer roller, 1st and 2nd passage, and a delivery passage, for, after printing on one side of a recording sheet is completed, reversing the recording sheet to print another side of the sheet is shown (patent documents 1).

RELATED ART DOCUMENT

Patent Documents

[Patent documents 1] Application Publication No. 09-193430

SUMMARY OF THE INVENTION

Object of the Invention

However, when outputting the image data photoed with the digital camera etc., in many cases, it is outputted(printed) from the printer equipped with roll sheet, and the thermal transfer printer shown above is one performing duplex printing to a recording sheet beforehand cut for one-sheet of predetermined size, and differs from one performing duplex printing to roll sheet. Moreover, in recent years, creating a photograph book etc. from images photoed with the digital camera etc. is often performed, and if bookbinding is performed using the paper that images are printed, such as photographs, on both sides by the thermal transfer method and photograph book is outputted, time and effort, such as sticking the receiver paper that images are printed to a booklets, is not taken, and quality bookbinding things, such as a photograph book, can be provided.

The present invention was made in view of the problem mentioned above, and the purpose is to provide the duplex printing method etc. for printing on both sides of roll sheet by a thermal transfer method.

Means for Solving the Object

The 1st invention to attain the purpose mentioned above is a duplex printing method for printing on both sides of a roll sheet by a thermal transfer method, comprising: printing firstly, in such a manner that a surface of 1st thermal transfer sheet in which a color material layer is provided touches 1st surface of the roll sheet and 2nd surface of the roll sheet touches 1st platen roller, superimposing and pressing the 1st thermal transfer sheet and the roll sheet between the 1st platen roller and 1st thermal head, making the 1st thermal head to generate heat according to image data while conveying the 1st thermal transfer sheet and the roll sheet, transferring a color material of a color material layer of the 1st thermal transfer sheet to the 1st surface of the roll sheet, and printing image on the 1st surface of the roll sheet, and printing secondly, in such a manner that a surface of 2nd thermal transfer sheet in which a color material layer is provided touches 2nd surface of the roll sheet and 1st surface of the roll sheet touches 2nd platen roller, superimposing and pressing the 2nd thermal transfer sheet and the roll sheet between the 2nd platen roller and 2nd thermal head, making the 2nd thermal head to generate heat according to image data while conveying the 2nd thermal transfer sheet and the roll sheet, transferring a color material of a color material layer of the 2nd thermal transfer sheet to the 2nd surface of the roll sheet, and printing image on the 2nd surface of the roll sheet.

According to above composition, since the color material of a thermal transfer sheet can be transferred to both sides of roll sheet, duplex printing of the roll sheet by a thermal transfer method is attained, and the photograph book etc. which are rich in design can be printed. Moreover, since a first printing process and a second printing process can be continuously performed, when printing much number of pages, such as a photograph book, back and front of the two or more pages can be printed in a short time.

Moreover, it is desirable that, when transferring a color material of a color material layer of the thermal transfer sheet to the roll sheet, conveyance of the roll sheet is performed with nipping the roll sheet by the 1st platen roller and 1st nip roller and nipping the roll sheet by the 2nd platen roller and 2nd nip roller.

According to above composition, conveyance of roll sheet can be ensured with nipping roll sheet by a nip roller and a platen roller. Moreover, since a nip roller is used, unevenness is not formed on a roll sheet.

Moreover, it is desirable that, in printing firstly, while printing image on the 1st surface of the roll sheet, a detection mark is formed on the 1st surface of the roll sheet, and in printing secondly, a position of an image to be printed on the 2nd surface of the roll sheet is aligned to a position of an image printed on the 1st surface of the roll sheet in printing firstly by detecting the detection mark by a sensor.

According to above composition, the position of the image printed on a roll sheet can be correctly aligned on both sides. Moreover, since detection mark is formed while printing image, even if a detection mark is not provided on roll sheet beforehand, it is possible to use ready-made things as roll sheet.

Moreover, it is also desirable that, in printing secondly, a position of an image to be printed on the 2nd surface of the roll sheet is aligned to a position of an image printed on the 1st surface of the roll sheet in printing firstly by detecting a tip of the roll sheet by a sensor.

According to above composition, the position of the image printed on roll sheet can be correctly aligned on both sides, and it is unnecessary to form a detection mark on roll sheet, and printing processes can be simplified.

The 2nd invention to attain the purpose mentioned above is a duplex printing method for printing on both sides of roll sheet by a thermal transfer method, comprising: printing firstly, in such a manner that a surface of a thermal transfer sheet in which a color material layer is provided touches 1st surface of the roll sheet and 2nd surface of the roll sheet touches a platen roller, superimposing and pressing the thermal transfer sheet and the roll sheet between the platen roller and a thermal head, making the thermal head to generate heat according to image data while conveying the thermal transfer sheet and the roll sheet, transferring a color material of a color material layer of the thermal transfer sheet to the 1st surface of the roll sheet, and printing image on the 1st surface of the roll sheet, conveying, pulling back the roll sheet from the platen roller, changing a conveyance course of the roll sheet and conveying the roll sheet toward the platen roller so that the platen roller touches the 1st surface of the roll sheet, and printing secondly, in such a manner that a surface of the thermal transfer sheet in which a color material layer is provided touches the 2nd surface of the roll sheet and the 1st surface of the roll sheet touches a platen roller, superimposing and pressing the thermal transfer sheet and the roll sheet between the platen roller and the thermal head, making the thermal head to generate heat according to image data while conveying the thermal transfer sheet and the roll sheet, transferring a color material of a color material layer of the thermal transfer sheet to the 2nd surface of the roll sheet, and printing image on the 2nd surface of the roll sheet.

According to above composition, since the color material of a thermal transfer sheet can be transferred to both sides of roll sheet, duplex printing of the roll sheet by a thermal transfer method is attained, and a photograph book rich in design, etc. can be created. Moreover, with the composition of one platen roller and one thermal head, duplex printing is attained by same size equipment as conventional printing equipment and furthermore, equipment itself with small size can be designed. Furthermore, when printing much number of pages, such as a photograph book, back and front of the two or more pages can be printed in a short time.

When transferring a color material of a color material layer of the thermal transfer sheet to the roll sheet, conveyance of the roll sheet can be performed with nipping the roll sheet by the platen roller and a nip roller. Moreover, conveyance of the roll sheet can also be performed with nipping the roll sheet by the platen roller and a clamp.

In the former, conveyance of roll sheet can be ensured with nipping roll sheet by a nip roller and a platen roller. Moreover, since a nip roller is used, unevenness is not formed in roll sheet.

In the latter, conveyance of roll sheet can be ensured with nipping roll sheet by a clamp and a platen roller. Since roll sheet can be held more correctly, printing images can be certainly aligned on both sides.

Moreover, conveyance of the roll sheet can be performed with nipping the roll sheet by a conveyance course and a clamp. And thereby, the flexibility of conveyance of roll sheet can be raised at the time of printing.

Furthermore, conveyance of the roll sheet can be performed with nipping the roll sheet by the platen roller and a clamp until predetermined conveyance length, and over predetermined conveyance length, can be performed with nipping the roll sheet by a conveyance course and a clamp. And thereby, roll sheet can be conveyed with nipped by the conveyance way or the platen roller, and a clamp according to the conveyance length of the roll sheet at the time of printing.

Moreover, it is desirable that, in printing firstly, while printing image on the 1st surface of the roll sheet, a detection mark is formed on the 1st surface of the roll sheet, and in printing secondly, a position of an image to be printed on the 2nd surface of the roll sheet is aligned to a position of an image printed on the 1st surface of the roll sheet in printing firstly by detecting the detection mark by a sensor.

According to above composition, the position of the image printed on roll sheet does not misaligned on both sides. Moreover, since detection mark is formed while printing a image, even if a detection mark is not formed on roll sheet beforehand, it is possible to use ready-made things as roll sheet.

Moreover, in printing secondly, a position of an image to be printed on the 2nd surface of the roll sheet can be aligned to a position of an image printed on the 1st surface of the roll sheet in printing firstly by detecting a tip of the roll sheet by a sensor.

According to above composition, the position of the image printed on roll sheet can be aligned correctly on both sides and it is unnecessary to form a detection mark on roll sheet, and printing processes can be simplified.

The 3rd invention to attain the purpose mentioned above is a duplex printing method for printing on both sides of roll sheet by a thermal transfer method, comprising: printing firstly, in such a manner that a surface of 1st thermal transfer sheet in which a color material layer is provided touches 1st surface of the roll sheet and 2nd surface of the roll sheet touches a platen roller, superimposing and pressing the 1st thermal transfer sheet and the roll sheet between the platen roller and 1st thermal head, making the 1st thermal head to generate heat according to image data while conveying the 1st thermal transfer sheet and the roll sheet, transferring a color material of a color material layer of the 1st thermal transfer sheet to the 1st surface of the roll sheet, and printing image on the 1st surface of the roll sheet, conveying, pulling back the roll sheet from the platen roller, changing a conveyance course of the roll sheet and conveying the roll sheet toward the platen roller so that the platen roller touches the 1st surface of the roll sheet, and printing secondly, in such a manner that a surface of 2nd thermal transfer sheet in which a color material layer is provided touches the 2nd surface of the roll sheet and the 1st surface of the roll sheet touches a platen roller, superimposing and pressing the 2nd thermal transfer sheet and the roll sheet between the platen roller and 2nd thermal head, making the 2nd thermal head to generate heat according to image data while conveying the 2nd thermal transfer sheet and the roll sheet, transferring a color material of a color material layer of the 2nd thermal transfer sheet to the 2nd surface of the roll sheet, and printing image on the 2nd surface of the roll sheet.

According to above composition, since the color material of a thermal transfer sheet can be transferred to both sides of roll sheet, duplex printing of the roll sheet by a thermal transfer method is attained, and a photograph book rich in design, etc. can be created. Moreover, with the composition of one platen roller and two thermal heads, duplex printing is attained by same size equipment as conventional printing equipment, and when printing much number of pages, such as a photograph book, back and front of the two or more pages can be printed in a short time.

When transferring a color material of a color material layer of the 1st or 2nd thermal transfer sheet to the roll sheet, conveyance of the roll sheet with nipping the roll sheet can be performed by the platen roller and a nip roller. Moreover, conveyance of the roll sheet can be performed with nipping the roll sheet by a platen roller and a clamp.

In the former, conveyance of roll sheet can be ensured with nipping roll sheet by a nip roller and a platen roller. Moreover, since a nip roller is used, unevenness is not formed in roll sheet.

In the latter, conveyance of roll sheet can be ensured with nipping roll sheet by a clamp and a platen roller. Since roll sheet can be held more correctly, a printing image can be certainly aligned on both sides.

Moreover, it is capable that, in printing firstly, while printing image on the 1st surface of the roll sheet, a detection mark is formed on the 1st surface of the roll sheet, and in printing secondly, when transferring a color material of a color material layer of the 2nd thermal transfer sheet to the roll sheet, conveyance of the roll sheet is performed with nipping the roll sheet by the platen roller and a nip roller, and a position of an image to be printed on the 2nd surface of the roll sheet is aligned to a position of an image printed on the 1st surface of the roll sheet in printing firstly by detecting the detection mark by a sensor.

According to above composition, even if roll sheet is conveyed with nipped by a platen roller and a nip roller when transferring the color material of the color material layer of the 2nd thermal transfer sheet to roll sheet, the position of the image printed on roll sheet does not misaligned on both sides. Moreover, since detection mark is formed while printing an image, even if a detection mark is not formed on roll sheet beforehand, it is possible to use ready-made things as roll sheet.

Moreover, it is capable that, in printing secondly, when transferring a color material of a color material layer of the 2nd thermal transfer sheet to the roll sheet, conveyance of the roll sheet is performed with nipping the roll sheet by the platen roller and a nip roller, and a position of an image to be printed on the 2nd surface of the roll sheet is aligned to a position of an image printed on the 1st surface of the roll sheet in printing firstly by detecting a tip of the roll sheet by a sensor.

According to above composition, even if roll sheet is conveyed with nipped by a platen roller and a nip roller when transferring the color material of the color material layer of the 2nd thermal transfer sheet to roll sheet, the position of the image printed on roll sheet does not misaligned on both sides. Moreover, it is unnecessary to form a detection mark while printing a picture, and printing processes can be simplified.

Moreover, in the duplex printing method of any one of the 1st, 2nd, and 3rd invention, control of duplex printing according to a maximum printing number of images which can be printed on one side at one conveyance can be performed by a control part. For example, efficient control of duplex printing is performed by such a method.

The 4th invention to attain the purpose mentioned above is a bookbinding method, comprising bookbinding, performing bookbinding using a roll sheet printed by a duplex printing method of any one of the 1st, 2nd, and 3rd invention.

According to above composition, quality bookbinding things, such as a photograph book, printed on both sides by the thermal transfer method can be provided without taking time and effort, such as sticking the receiver paper printed on a booklet etc.

For example, in bookbinding, roll sheets cut for every sheet of a bookbinding thing are piled and bound at one side, and a bookbinding thing is created. Thereby quality bookbinding things, such as a photograph book, can be provided.

Moreover, an end part of the roll sheet corresponding to the one side to be bound can be ground coarsely. Thereby the adhesiveness of the end of roll sheets can be increased when pasted in bookbinding.

Moreover, in bookbinding, a roll sheet cut for every two or more sheets of a bookbinding thing is folded and bound at one side, a side which faces the one side bound is cut, and a bookbinding thing is created. Thereby quality bookbinding things, such as a photograph book, can also be provided.

An end part of the roll sheet corresponding to the one side to be bound can be ground coarsely, like the above. Thereby the adhesiveness of the end of roll sheet can be increased when pasted in bookbinding.

Moreover, when folding the roll sheet, between the one side to be bound and a side which faces this, a portion which folds the roll sheet at a short interval can be provided. Or it is also capable that, in bookbinding, a roll sheet cut for every sheet of a bookbinding thing is piled and bound with a roll sheet cut by predetermined length and folded so that a portion which is folded is formed between a side to be bound in a bookbinding thing and a side which faces this. Thereby, a page longer than others can be provided in a bookbinding thing, and change can be given to bookbinding size.

Moreover, it is also capable that, in bookbinding, a roll sheet cut for every two or more sheets of a bookbinding thing is folded and bound between sides folded, a side folded is cut, and a bound position is folded further. Thereby quality bookbinding things, such as a photograph book, can also be provided.

The 5th invention to attain the purpose mentioned above is a printer for use in duplex printing method of any one of the 1st, 2nd, and 3rd invention.

The Effect of Invention

By the present invention, the duplex printing method etc. for printing on both sides of roll sheet by a thermal transfer method can be provided.

BRIEF DESCRIPTION OF THE DRAWINGS

FIG. 11. The figure showing an example of the printer for duplex printing 1 for performing printing by the duplex printing method of the 4 th embodiment FIG. 12(*a*) to (*f*). The figures each showing an example of a procedure which performs duplex printing by the duplex printing method of the 4 th embodiment FIG. 13(*a*) and (*b*). The figures each showing an example of the composition using the clamp 53*a* (53*b*) in the printer for duplex printing 1 of the 4 th embodiment FIG. 14(*a*) and (*b*). The figures each showing an example of the composition of the bookbinding machine 100

FIG. 15(*a*) and (*b*). The figures each showing an example of the bookbinding method FIG. 16(*a*) to (*d*). The figures each showing an example of the bookbinding method FIG. 17(*a*) to (*e*). The figures each showing an example of the bookbinding method FIG. 18. The figure showing an example of printing on the roll sheet 3

FIG. 19(*a*) and (*e*). The figures each showing an example of the bookbinding method.

DESCRIPTION OF EMBODIMENTS

[The 1st Embodiment]

Hereafter, based on FIG. 1 to 5, the 1st embodiment of the duplex printing method of the present invention will be explained in detail. In addition, the duplex printing method of the present invention can be applied to a sublimation transfer method or a molten transfer method among thermal transfer methods, and if an image is printed by a sublimation transfer method, since tonality is excellent, photographic printed things (printings) of high resolution like a photograph is obtained. Moreover, when forming a picture (printing ) by a molten transfer method, the merit of a molten transfer system is demonstrated enough for the case that durability is needed, and for an illustration with contrast etc.

Figure 1:
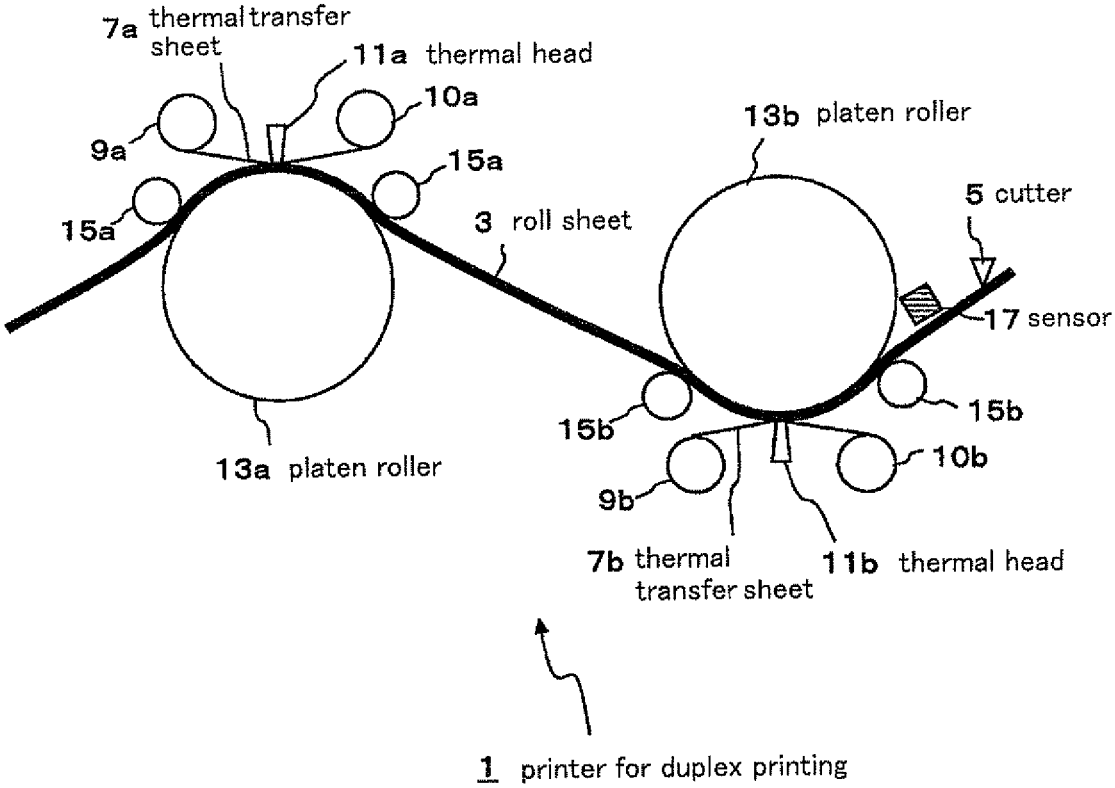
FIG. 1. The figure showing an example of the printer for duplex printing 1 for performing printing by the duplex printing method of the 1st embodiment FIG. 2. The figure showing an example of the plane composition of the thermal transfer sheets 7*a* and 7*b*

FIG. 1 is a figure showing an example of the printer for duplex printing for performing printing by the duplex printing method of this embodiment.

In the printer for duplex printing 1 of FIG. 1, 3 is a roll sheet, 5 is a cutter, 7*a*, 7*b* are thermal transfer sheets, 9*a*, 9*b* are thermal transfer sheet feed rolls, 10*a*, 10*b* are thermal transfer sheet rolling-up rolls, 11*a*, 11*b* are thermal heads, 13*a*, 13*b* are platen rollers, 15*a*, 15*b* are nip rollers and 17 is a sensor.

In addition, the printer for duplex printing 1 is equipped with the conveyance mechanism of the roll sheet which consists of rollers and conveyance ways etc., and the control part which performs printing control (unillustrated).

The roll sheet 3 is conveyed by a conveyance roller etc. from a feed roll (un-illustrated) to perform duplex printing. The details of the roll sheet 3 will be mentioned later.

The cutter 5 is used to cut the roll sheet 3 after performing duplex printing.

The thermal transfer sheet 7*a* (7*b*) is provided with color material layers, such as Y (yellow), M (magenta), and C (cyan). The details of the thermal transfer sheet 7*a* (7*b*) will be mentioned later.

The thermal transfer sheet feed roll 9*a* (9*b*) is twisted with the thermal transfer sheet 7*a* (7*b*), The thermal transfer sheet 7*a* (7*b*) twisted around the thermal transfer sheet feed roll 9*a* (9*b*) is conveyed at the time of printing, and is rolled round by the thermal transfer sheet rolling-up roll 10*a* (lob) via the heat generation part of the below-mentioned thermal head Ha (11*b*).

The thermal head 11*a* (11*b*) has a heat generation part, an image data input part, a rise-and-fall part, and a control part, etc.(un-illustrated).

When printing, the thermal head 11*a* (11*b*), while pressing the thermal transfer sheet 7*a* (7*b*) to the roll sheet 3 between itself and the below-mentioned platen roller 13*a* (13*b*), makes the heat generation element which constitutes an heat generation part to generate heat according to the image data inputted from the image data input part, and the color material of the color material layer of the above-mentioned thermal transfer sheet 7*a* (7*b*) is transferred to the roll sheet 3.

The platen roller 13*a* (13*b*) is cylindrical, can be equipped with drive mechanism (un-illustrated), such as a motor, and conveys the roll sheet 3 at the time of printing. While the roll sheet 3 is conveyed along the cylindrical surface of the platen roller 13*a* (13*b*), printing by the thermal head 11*a* (11*b*) is performed.

The nip roller 15*a* (15*b*) is a roller to assist conveyance of the roll sheet 3. A set of nip rollers 15*a* (15*b*) is set at the position which sandwiches the thermal head 11*a* (11*b*) and is close to the platen roller 13*a* (13*b*).

At the time of printing, the roll sheet 3 is conveyed surely with nipped by the platen roller 13*a* (13*b*) and the nip roller 15*a* (15*b*). Moreover, the nip roller 15*a* (15*b*) has the smooth surface, and does not make unevenness on the surface of the roll sheet 3.

The sensor 17 detects the below-mentioned detection mark 49 formed in the roll sheet 3 when aligning the positions of images to print on the roll sheet 3 by both sides. Various combinations of the detection mark 49 and the sensor 17 is considered, for example, the sensor 17 can be an infrared sensor etc. The detection mark 49 will be mentioned later.

And although the sensor 17 is positioned at the lower stream side of the thermal head 11*b* along a print direction (rights direction in FIG. 1), the position of the sensor 17 is not restricted to this, and can be positioned at the upper stream side of the thermal head 11*b* along a print direction.

Next, the composition of the thermal transfer sheet 7*a* (7*b*) of this embodiment will be explained, referring to FIG. 2.

Figure 2:
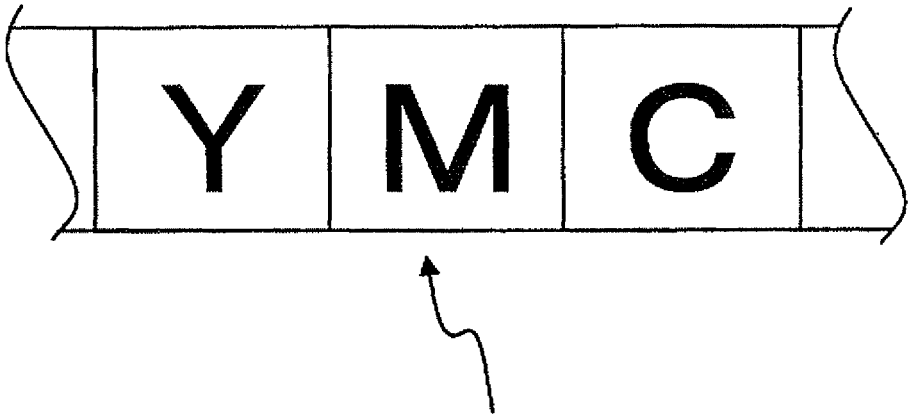

FIG. 2 is a figure showing an example of the plane composition of the thermal transfer sheet 7*a* (7*b*).

The thermal transfer sheet 7*a* (7*b*) has a color material layer on a base material sheet. Known conventional various things can be used as the thermal transfer sheet 7*a* (7*b*).

As shown in FIG. 2, as the plane composition of the thermal transfer sheet 7*a* (7*b*), a color material layer of Y (yellow), M (magenta), or C (cyan) is provided in field sequential. The order of transfer of a color material is set to Y (yellow), M (magenta), and C (cyan). And not only the plane composition shown in FIG. 2, the domain which has a protection layer for protecting the printed image can be added further as plane composition of a thermal transfer sheet, for example. Moreover, the domain which has a color material layer of K (black) can be further added as plane composition. In addition, according to the purpose of printing, the domain which has a color material layer of gold and silver, and a hologram layer etc. can be added, and the special color transfer can also be performed.

Figure 3:
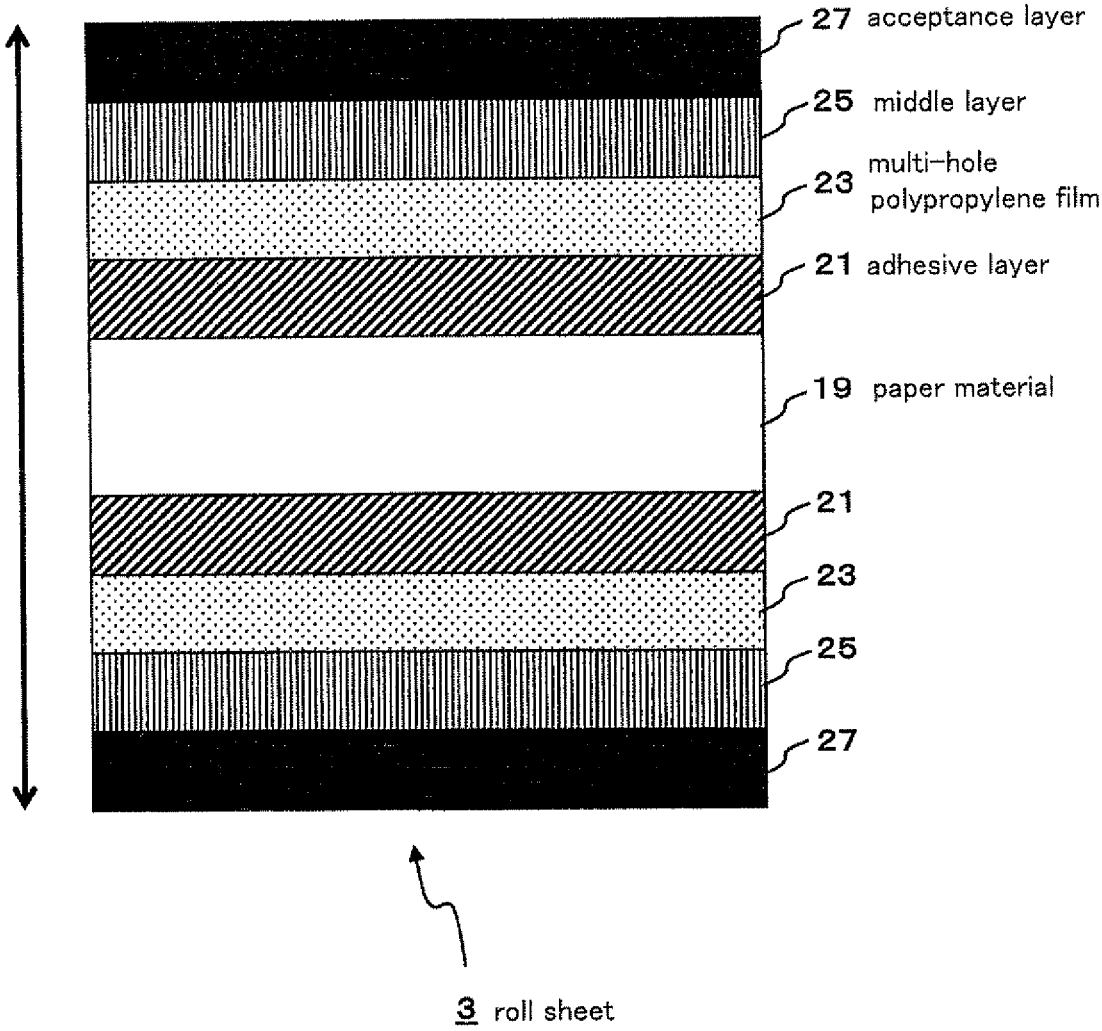
FIG. 3.T*he* figure showing an example of the cross-sectional composition of the roll sheet 3

Next, the details of the roll sheet 3 of this embodiment will be explained, referring to FIG. 3. FIG. 3 is a figure showing an example of the cross-sectional composition of the roll sheet 3.

The roll sheet 3 has the composition that the adhesive layer 21, multi-hole polypropylene film 23, the middle layer 25, and the acceptance layer 27 are sequentially formed in both sides of the paper material 19.

In view of intensity, heat resistance, the dyeing property of a color material, etc., various composition or materials can be used for them.

As for the thickness of roll sheet, it is desirable to use one with 50~300 μm thickness in accordance with the textures of the page of the printed things (photograph book etc.) finally formed.

Moreover, the color material of a thermal transfer sheet is transferred to the acceptance layer 27 of the roll sheet 3, and because this acceptance layer 27 formed in both sides, duplex printing on the roll sheet 3 is possible.

Then, the procedure of performing duplex printing of the 1st embodiment of the present invention will be explained, referring to FIG. 4.

Figure 4:
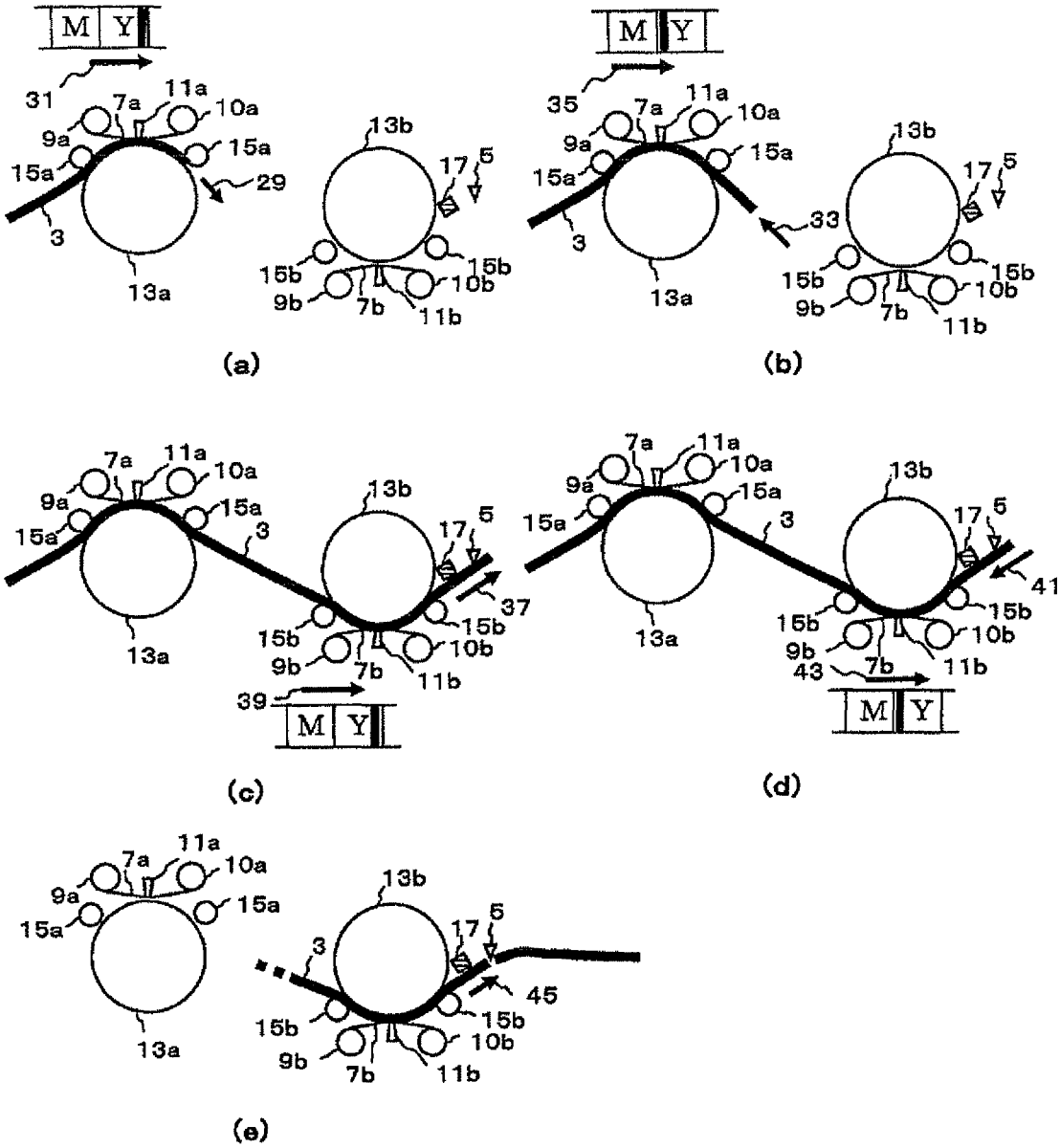
FIGS. 4(*a*) to (*e*). The figures each showing an example of a procedure which performs duplex printing by the duplex printing method of the 1 st embodiment FIG. 5. The figure showing an example of the detection mark 49 formed in the roll sheet 3

FIG. 4 is a figure showing an example of a procedure which performs duplex printing.

At the time of the start of duplex printing, at first, search is performed so that one end of the domain in which the color material layer of Y (yellow) is provided of the thermal transfer sheet 7*a* comes to the position of the thermal head 11*a*.

In addition, the roll sheet 3 is conveyed by a conveyance roller etc. so that the printing starting position of the first printing image of the roll sheet 3 comes to the position of the thermal head 11*a* above the platen roller 13*a*.

Moreover, near the both sides of the thermal head 11*a*, the roll sheet 3 is nipped by the platen roller 13*a* and the nip roller 15*a*. And the bottom surface (the 2nd surface) of the roll sheet 3 touches the platen roller 13*a*, and the top surface (the 1st surface) of the roll sheet 3 faces the thermal head 11*a*, at the position of the thermal head 11*a*.

Since the roll sheet 3 is nipped by the platen roller 13*a* and the nip roller 15*a*, conveyance of the roll sheet 3 can be ensured.

Subsequently, the thermal head 11*a* presses the bottom surface (surface in which the color material layer is provided) of the thermal transfer sheet 7*a* to the top surface (the 1st surface) of the roll sheet 3.

That is, the thermal transfer sheet 7*a* and the roll sheet 3 are superimposed and pressed between the thermal head 11*a* and the platen roller 13*a* in such a manner that the bottom surface of the thermal transfer sheet 7*a* touches the top surface of the roll sheet 3.

The state which showed above is shown in FIG. 4(*a*).

Then, the image corresponding to the amount of Y (yellow) ingredients of the image to print is transferred by a thermal transfer method, with conveying the roll sheet 3 in the direction of the arrow 29 and conveying the thermal transfer sheet 7*a* in the direction of the arrow 31, respectively.

That is, the heat generation element of the heat generation part of the thermal head 11*a* generates heat according to the amount of Y (yellow) ingredients of image data, and the color material of Y (yellow) of the thermal transfer sheet 7*a* is transferred to the top surface (the 1st surface) of the roll sheet 3 only by the quantity according to the amount of Y (yellow) ingredients of image data.

The state after transferring the color material of Y (yellow) in this way is FIG. 4(*b*).

After finishing transfer of the color material of Y (yellow), the thermal head 11*a* is raised, the thermal transfer sheet 7*a* is separated from the roll sheet 3, and the roll sheet 3 is pulled back in the direction shown in the arrow 33. The quantity that the roll sheet 3 is pulled back is equal to the quantity that the roll sheet 3 is conveyed at the time of transfer, so the printing starting position of the first printing image comes to the same position as the thermal head 11*a* again.

Moreover, the thermal transfer sheet 7*a* is conveyed in the direction of the arrow 35 and search is performed so that the one end of the domain of the color material layer of M (magenta) of the thermal transfer sheet 7*a* comes to the position of the thermal head 11*a*.

Then, the color material of M (magenta) and C (cyan) is transferred according to the amount of ingredients of each color of image data in the same procedure. Moreover, according to the printing purpose, transfer of a color material of K (black), gold and silver, and a hologram, and transfer of a protection layer etc. can be performed.

In this way, the color material of each color etc. are transferred according to image data and one image is printed on the top surface (the 1st surface) of the roll sheet 3, then the roll sheet 3 is sent by predetermined quantity to the next image printing domain and an image is printed in the same procedure.

However, printing of image can be performed for every sheet, and in this case, a procedure of duplex printing is that, after printing one image on the top surface (the 1st surface) of the roll sheet 3, the roll sheet 3 is sent toward the platen roller 13*b*, and printing on the bottom surface (the 2nd surface) of the roll sheet 3 is performed.

Moreover, at the time of printing image, a detection mark can be formed in the roll sheet 3. It is convenient to print a detection mark while printing image, when the length of a page changes (a cover, a spine of cover, a center-page spread, a filed page, etc.) in producing a photograph book etc.

The detection mark formed in the roll sheet 3 in the duplex printing method of this embodiment will be explained using FIG. 5.

Figure 5:
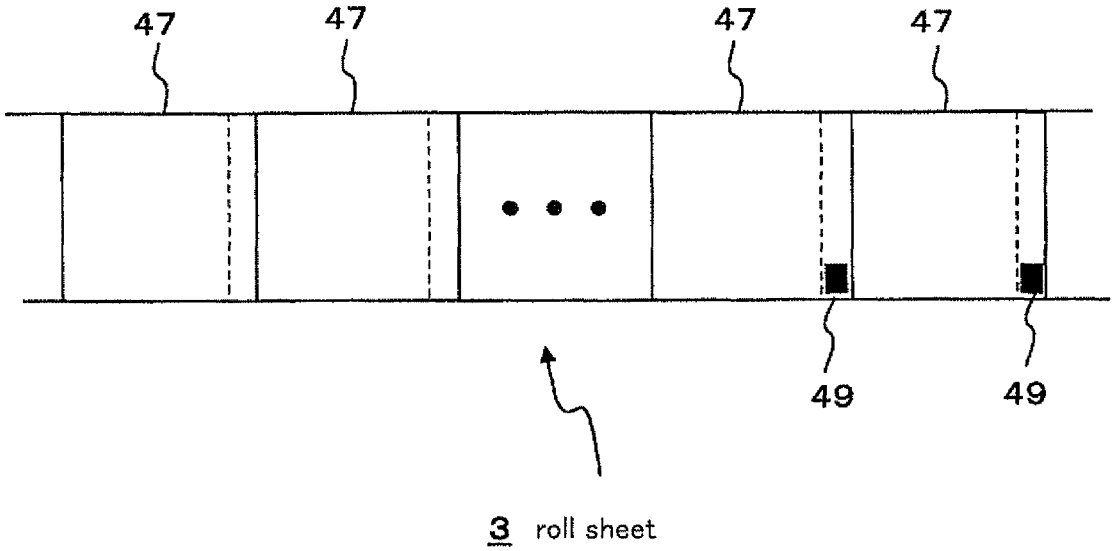

FIG. 5 is a figure showing an example of the detection mark 49 formed in the roll sheet 3.

In FIG. 5, 47 is a domain where one image is printed, and the same domain is provided at both sides. However, right-hand side of dotted line in each domain of FIG. 5 is a domain where a color material is not transferred at the tip of an image printing domain. This corresponds to a margin in bookbinding, for example. The detection mark 49 is formed in this position.

The detection mark 49 is formed in the roll sheet 3 with printing image. The detection mark 49 is a minute mark detectable by the sensor 17, printed on the roll sheet 3. For example, the sensor 17 can be an infrared sensor and the detection mark 49 can be formed with the color material containing carbon black.

However, the detection mark 49 can be printed in advance on the roll sheet 3 (when printing size is fixed etc.), and in this case, it is unnecessary to form the detection mark 49 on the roll sheet 3 when printing image.

Moreover, not only the position of FIG. 5, a detection mark can be formed in the domain where an image is not transferred according to the size of printing, or the pattern of bookbinding. Moreover, the form can also be set variously.

Furthermore, in addition to this, as a detection mark, various things can be considered. For example, the minute domain which is different from the surrounding domain in the degree of gloss is formed as a detection mark, and the difference of the degree of gloss can be detected by an optical sensor.

Now, after printing a predetermined number of images in this way, the tip of the roll sheet 3 is sent out toward the platen roller 13*b* (2nd platen roller).

The sent-out roll sheet 3 reaches the platen roller 13*b*. In the position of the thermal head 11*b*, the top surface (the 1st surface) of the roll sheet 3 previously printed touches the platen roller 13*b*, the bottom surface (the 2nd surface) of the roll sheet 3 faces the thermal head 11*b*, and it becomes a surface to be printed.

Moreover, near the both sides of the thermal head 11*b*, the roll sheet 3 is nipped by the platen roller 13*b* and the nip roller 15*b*.

When the sensor 17 detects the detection mark 49 formed at the tip of the first image printing domain of the roll sheet 3, the first image printing domain of the roll sheet 3 is set at the position of the thermal head 11*b*.

The sensor 17 is arranged so that the printing starting position of the image printing domain of the roll sheet 3 comes to the position of the thermal head 11*b* when detecting the detection mark 49 by the sensor 17.

Thus, alignment of images printed on both sides is performed at the time of printing.

However, the sensor 17 can be arranged so that the printing starting position of the image printing domain of the roll sheet 3 separates from the position of the thermal head 11*b* by predetermined quantity when detecting the detection mark 49 by the sensor 17. In this case, alignment of images printed on both sides is performed by pulling back or sending out the roll sheet 3 by predetermined quantity after detecting the detection mark 49 by the sensor 17. Moreover, it is the same even when the sensor 17 is arranged at the upper stream side of the thermal head 11*b* along a print direction.

Moreover, conveyance control (alignment of images printed on both sides) of the roll sheet 3 can be performed by detecting the tip of the roll sheet 3 by the sensor which detects the tip of the roll sheet 3, instead of the sensor 17. This can be performed by providing a sensor which detects an element which is different between the surface of platen rollers and the surface of the roll sheet 3, such as color, for example. In this case, when printing on the top surface (the 1st surface) of the roll sheet 3, it is unnecessary to form the detection mark 49. Moreover, the arrangement of a sensor can be set variously in this case as well as the above.

Furthermore, search is performed so that one end of the domain of the color material layer of Y (yellow) of the thermal transfer sheet 7*b* comes to the position of the thermal head 11*b*.

The above state is shown in FIG. 4(*c*).

Then, the thermal head 11*b* presses the top surface (surface in which the color material layer is provided) of the thermal transfer sheet 7*b* to the bottom surface (the 2nd surface) of the roll sheet 3.

That is, the thermal transfer sheet 7*b* and the roll sheet 3 are superimposed and pressed between the thermal head 11*b* and the platen roller 13*b* in such a manner that the top surface of the thermal transfer sheet 7*b* touches the bottom surface of the roll sheet 3.

Then, the image corresponding to the amount of Y (yellow) ingredients of the image to print is transferred by a thermal transfer method, with conveying the roll sheet 3 in the direction of the arrow 37 and conveying the thermal transfer sheet 7*b* in the direction of the arrow 39.

The state after transferring the color material of Y (yellow) is FIG. 4(*d*).

After finishing transfer of the color material of Y (yellow), the thermal head 11*b* is lowered, the thermal transfer sheet 7*b* is separated from the roll sheet 3, the roll sheet 3 is pulled back in the direction shown in the arrow 41 until the sensor 17 detects the detection mark 49 again.

When the sensor 17 detects the detection mark 49 again, the printing starting position of the first printing image comes to the same position as the thermal head 11*b* again.

Moreover, the thermal transfer sheet 7*b* is conveyed in the direction of the arrow 43 and search is performed so that one end of the domain of the color material layer of M (magenta) of the thermal transfer sheet 7*b* comes to the position of the thermal head 11*b*.

Hereafter, printing is performed in the same procedure with changing the color material to transfer to M (magenta) or C (cyan). Of course, printing on the bottom surface (the 2nd surface) of the roll sheet 3 and printing on the top surface (the 1st surface) of the roll sheet 3 above-mentioned can be performed in parallel.

When transfer of the color material of each color etc. is performed, one image is printed on the bottom surface (the 2nd surface) of the roll sheet 3.

After printing of one image is completed in this way, the roll sheet 3 is sent out until the next detection mark 49 is detected. Since the printing starting position of the following printing image is aligned to the position of the thermal head 11*b* at this time, subsequently the following image is printed in the same procedure.

However, as mentioned above, images can be printed for every sheet, and in this case, after printing one image on the bottom surface (the 2nd surface) of the roll sheet 3, the procedure shifts to cut the roll sheet 3.

As explained above, alignment of the images on both sides at the time of printing is correctly performed by detection of the detection mark 49 by the sensor 17. This prevents misalignment of images to print on both sides of the roll sheet 3.

In addition, as previously mentioned, it is also possible to print the detection mark 49 on the roll sheet 3 in advance. In this case, it is desirable that, not only when printing on the bottom surface (the 2nd surface) of the roll sheet 3 mentioned above, but when printing on the top surface (the 1st surface) of the roll sheet 3, a printing starting position is defined by a sensor. That is, when a sensor detects the predetermined detection mark 49 printed in advance, or after conveying predetermined quantity after a sensor detects the detection mark 49, the printing starting position of the printing image of the roll sheet 3 comes to the position of the thermal head 11*a*. In this way, the position of a printing image can be defined more correctly at the time of printing on the top surface (the 1st surface) of the roll sheet 3. As a result, alignment of images to print on both sides can be performed more correctly. It is also the same as when using the sensor which detects the tip of the roll sheet 3. Also about these cases, arrangement of the sensor can be determined variously as mentioned above.

In this way, after printing a predetermined number of images on the bottom surface (the 2nd surface) of the roll sheet 3 and completing duplex printing of predetermined quantity, as shown in FIG. 4(*e*), the cutter 5 cuts the roll sheet 3 according to the domain where the image was printed.

Here, in the conveyance course of the roll sheet 3 between the thermal head Ha and the thermal head 11*b*, the conveyance buffer part (extra conveyance way) which absorbs and buffers the difference of the conveyance speed of the roll sheet 3 at the time of printing on the top surface (the 1st surface) and the bottom surface (the 2nd surface) etc. can be provided in order to keep the tension by conveyance of the roll sheet 3 and the thermal transfer sheets 7*a*, 7*b* when printing on the top surface (the 1st surface) and the bottom surface (the 2nd surface) of the roll sheet 3 etc. constant. This is realizable in the slack part which slacks the roll sheet 3 etc. For example, in the conveyance course between the thermal head 11*a* and the thermal head lib, the conveyance roller (un-illustrated) which operates in accordance with conveyance of the roll sheet 3 at the time of printing on the top surface (the 1st surface) is provided at a side of the thermal head 11*a*, and the conveyance roller (un-illustrated) which operates in accordance with conveyance of the roll sheet 3 at the time of printing on the bottom surface (the 2nd surface) is provided at the side of the thermal head 11*b*, and the state that slack of the roll sheet 3 more than predetermined length is made among a set of these conveyance rollers is kept. Thereby, when printing on the top surface (the 1st surface) and the bottom surface (the 2nd surface) of the roll sheet 3, the tension by conveyance of the roll sheet 3 and the thermal transfer sheets 7*a*, 7*b* can be kept constant.

In addition, the amount of slack is detected by a sensor (un-illustrated) etc., and for example, when the amount of slack becomes below predetermined length, conveyance speed in printing of the top surface (the 1st surface) of the roll sheet 3 is increased or either one of the top surface (the 1st surface) or the bottom surface (the 2nd surface) is printed only. Thus, by controlling conveyance speed at the time of printing of the top surface (the 1st surface) or the bottom surface (the 2nd surface) of the roll sheet 3 etc., or the selection of the printing unit of whether prints on the top surface (the 1st surface) of the roll sheet 3 by the thermal head 11*a* etc. or on the bottom surface (the 2nd surface) of the roll sheet 3 by the thermal head 11*b* etc., according the amount of slack, the state that slack of the roll sheet 3 more than predetermined length is always made can be kept.

As explained above, the duplex printing method etc. for printing on both sides of roll sheet by a thermal transfer method can be provided, according to this embodiment.

[The 2nd Embodiment]

Based on FIG. 6 and FIG. 7, the 2nd embodiment of the duplex printing method of the present invention will be explained in detail below.

Figure 6:
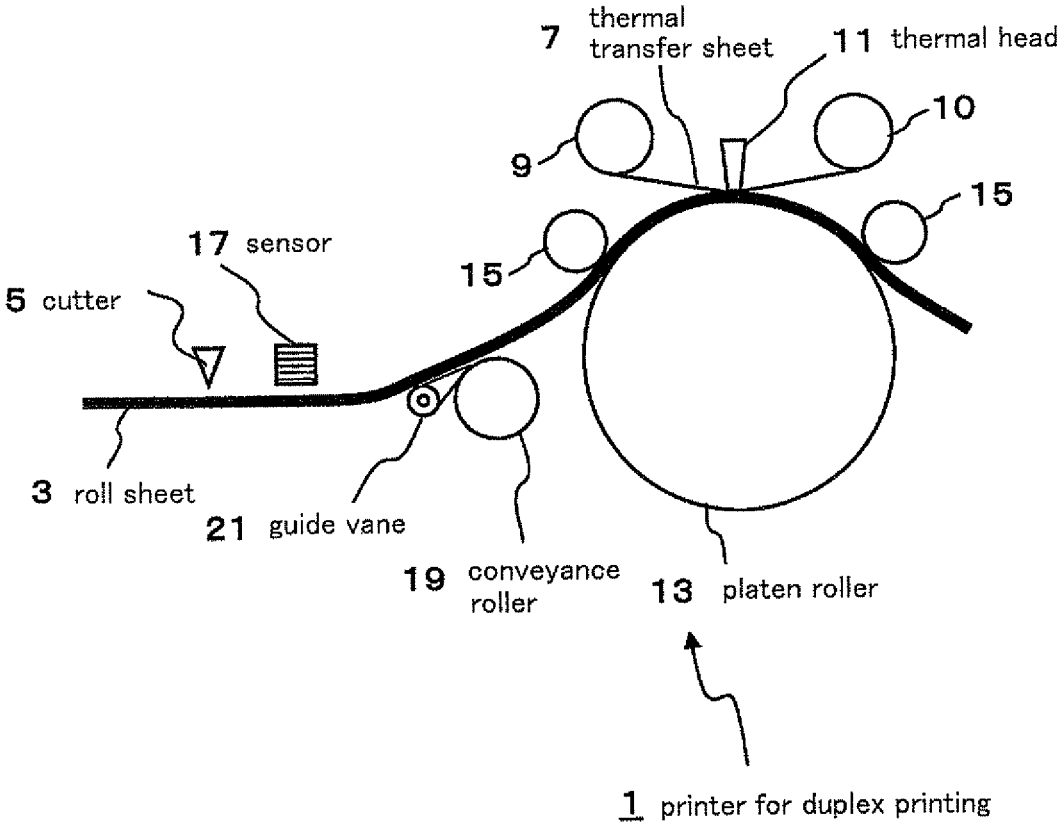
FIG. 6. The figure showing an example of the printer for duplex printing 1 for performing printing by the duplex printing method of the 2 nd embodiment FIG. 7 FIGS. 7(*a*) to (*f*). The figure figures each showing an example of a procedure which performs duplex printing by the duplex printing method of the 2 nd embodiment FIG. 8. The figure showing an example of the printer for duplex printing 1 for performing printing by the duplex printing method of the 3 rd embodiment FIG. 9 FIGS. 9(*a*) to (*f*). The figure figures each showing an example of a procedure which performs duplex printing by the duplex printing method of the 3 rd embodiment FIG. 10 FIGS. 10(*a*) to (*c*). The figure figures each showing an example of the conveyance way 56

FIG. 6 is a figure showing an example of the printer for duplex printing for performing printing by the duplex printing method of the 2nd embodiment the present invention.

In the printer for duplex printing 1 of FIG. 6, 3 is a roll sheet, 5 is a cutter, 7 is a thermal transfer sheet, 9 is a thermal transfer sheet feed roll, 10 is a thermal transfer sheet rolling-up roll, 11 is a thermal head, 13 is a platen roller, 15 is a nip roller, 17 is a sensor, 19 is a conveyance roller and 21 a guide vane.

In addition, the printer for duplex printing 1 is equipped with the conveyance mechanism of the roll sheet which consists of a roller and a conveyance way etc., and the control part which performs printing control (un-illustrated).

In FIG. 6, the sensor 17 is arranged at the upper stream side of the thermal head 11 along a print direction. However, as mentioned later, the position of the sensor 17 is not restricted to this and the sensor 17 can be arranged at the lower stream side of the thermal head 11 along a print direction, for example.

The conveyance roller 19 is a part of conveyance mechanism of the roll sheet 3. The roll sheet 3 can be conveyed above the conveyance roller 19 or the roll sheet 3 can be conveyed under the conveyance roller 19.

The guide vane 21 is used in order to change the conveyance direction of the roll sheet 3 to above the conveyance roller 19 or under the conveyance roller 19 by changing a direction.

As for the cutter 5, the thermal transfer sheet feed roll 9, the thermal transfer sheet rolling-up roll 10, the thermal head 11, the platen roller 13, the nip roller 15, the sensor 17 etc., the same thing as explained in the 1st embodiment can be used. Moreover, also as for the thermal transfer sheet 7 and the roll sheet 3, the same thing as explained in the 1st embodiment can be used.

Then, the flow of the duplex printing method of the 2nd embodiment of the present invention will be explained, referring to FIG. 7.

Figure 7:
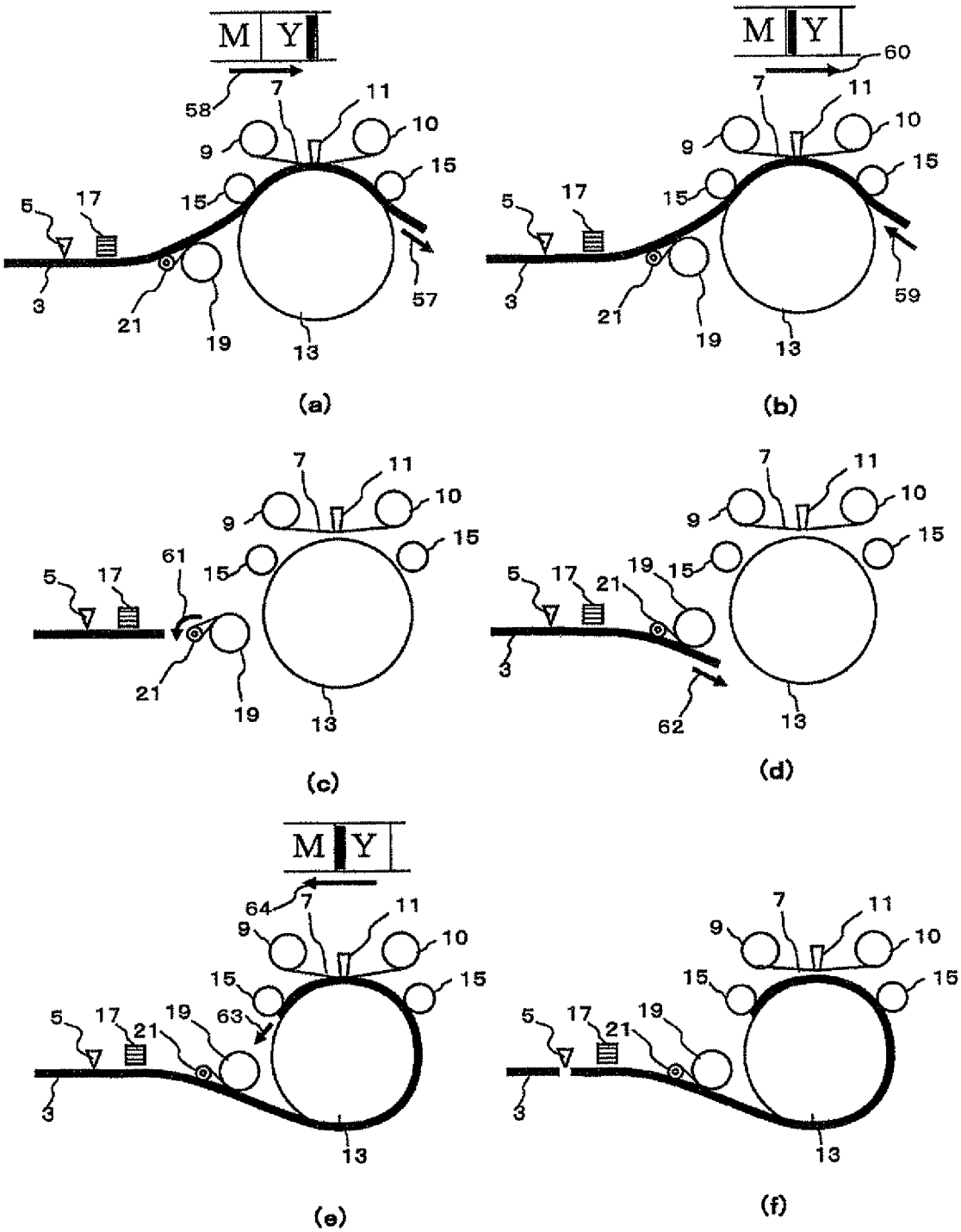

FIG. 7 is a figure showing an example of a procedure which performs duplex printing by the duplex printing method of the 2nd embodiment of the present invention.

At the time of the start of duplex printing, at first, search is performed so that one end of the domain in which the color material layer of Y (yellow) is provided of the thermal transfer sheet 7 comes to the position of the thermal head 11.

In addition, the roll sheet 3 is sent out by conveyance roller 19 etc. so that the printing starting position of the first printing image of the roll sheet 3 comes to the position of the thermal head 11 above the platen roller 13. At this time, the guide vane 21 turns upward, and the roll sheet 3 is sent out above the conveyance roller 19 along with the guide vane 21.

Moreover, near the both sides of the thermal head 11, the roll sheet 3 is nipped by the platen roller 13 and the nip roller 15. In the position of the thermal head 11, the bottom surface (the 2nd surface) of the roll sheet 3 touches the platen roller 13, and the top surface (the 1st surface) of the roll sheet 3 faces the thermal head 11.

Since the roll sheet 3 is nipped by the platen roller 13 and the nip roller 15, conveyance of the roll sheet 3 can be ensured.

Subsequently, the thermal head 11 presses the bottom surface (surface in which the color material layer is provided) of the thermal transfer sheet 7 to the top surface (the 1st surface) of the roll sheet 3.

That is, the thermal transfer sheet 7 and the roll sheet 3 are superimposed and pressed between the thermal head 11 and the platen roller 13 in such a manner that the bottom surface of the thermal transfer sheet 7 touches the top surface of the roll sheet 3. The state which showed above is shown in FIG. 7(*a*).

Then, the image corresponding to the amount of Y (yellow) ingredients of the image to print is transferred by a thermal transfer method, with conveying the roll sheet 3 in the direction of the arrow 57 and conveying the thermal transfer sheet 7 in the direction of the arrow 58, respectively.

That is, the heat generation element of the heat generation part of the thermal head 11 generates heat according to the amount of Y (yellow) ingredients of image data, and the color material of Y (yellow) of the thermal transfer sheet 7 is transferred to the top surface (the 1st surface) of the roll sheet 3 only by the quantity according to the amount of Y (yellow) ingredients of image data.

Thus, the state after transferring the color material of Y (yellow) is FIG. 7(*b*).

After finishing transfer of the color material of Y (yellow), the thermal head 11 is raised, the thermal transfer sheet 7 is separated from the roll sheet 3, and the roll sheet 3 is pulled back in the direction shown in the arrow 59. The quantity that the roll sheet 3 is pulled back is same as the quantity that the roll sheet 3 is conveyed at the time of transfer, and the printing starting position of the first printing image comes to the same position as the thermal head 11 again.

Moreover, the thermal transfer sheet 7 is conveyed in the direction of the arrow 60 and search is performed so that one end of the domain of the color material layer of M (magenta) of the thermal transfer sheet 7 comes to the position of the thermal head 11.

Then, the color material of M (magenta) and C (cyan) is transferred according to the amount of ingredients of each color of image data in the same procedure. Moreover, according to the printing purpose, a color material of K (black), gold and silver, a hologram, and a protection layer etc. can be transferred.

Thus, when the color material of each color etc. are transferred according to image data and one image is printed on the top surface (the 1st surface) of the roll sheet 3, the roll sheet 3 is sent out by predetermined quantity so that the printing starting position of the following printing image comes to the position of the thermal head 11 and an image is printed in same procedure.

However, images can be printed for every sheet, and in this case, a procedure of duplex printing is that, after printing one image on the top surface (the 1st surface) of the roll sheet 3, the roll sheet 3 is pulled back from the platen roller 13 and the conveyance direction is changed, then the roll sheet 3 is sent out toward the platen roller 13, and printing on the 2nd surface of the roll sheet 3 is performed.

Moreover, at the time of printing of an image, the detection mark 49 can be formed in the roll sheet 3.

Thus, after printing a predetermined number of images, as shown in FIG. 7(*c*), the roll sheet 3 is pulled back, and after separating the tip of the roll sheet 3 from the platen roller 13, the guide vane 21 is rotated as shown in the arrow 61 and turned downward, and the conveyance course of the roll sheet 3 toward the platen roller 13 is changed to lower side.

Then, as shown in FIG. 7(*d*), the roll sheet 3 is sent out toward the platen roller 13. At this time, the guide vane 21 turns downward, and the roll sheet 3 is conveyed in the direction of the arrow 62 under the conveyance roller 19 along with the guide vane 21.

Furthermore, the roll sheet 3 is conveyed with twisted around the platen roller 13 so that the surface which printed first (the 1st surface) of the roll sheet 3 touches the platen roller 13. The roll sheet 3 of predetermined quantity is conveyed so that the printing starting position of the first printing image of the roll sheet 3 comes to the position of the thermal head 11.

The state that the roll sheet 3 is conveyed is shown in FIG. 7(*e*).

Moreover, at this time, the sensor 17 detects the detection mark 49 formed in the 1st surface of the roll sheet 3.

The sensor 17 is arranged so that the printing starting position of the printing image of the roll sheet 3 comes to the position of the thermal head 11 when the sensor 17 detects the predetermined detection mark 49. Thus, alignment of the images to print on both sides is performed. At this time, alignment can be performed by detection of the detection mark 49 of the domain different from the domain to be printed. Moreover, the position of the sensor 17 is not restricted to what shown in FIG. 7(*e*) and in FIG. 7(*e*), the sensor 17 can be arranged at near the nip roller 15 near the tip of the roll sheet 3 at the lower stream side of the thermal head 11 along a print direction, for example.

Moreover, the sensor 17 can be arranged so that the printing starting position of the printing image of the roll sheet 3 separates from the position of the thermal head 11 by predetermined quantity when the sensor 17 detects the detection mark 49. In this case, alignment of images to print on both sides is performed by pulling back or sending out the roll sheet 3 of predetermined quantity after detecting the detection mark 49 by the sensor 17.

Moreover, using a sensor detecting the tip of the roll sheet 3 instead of the sensor 17, conveyance control (alignment of images to print on both sides) can be performed by detecting the tip of the roll sheet 3 by this sensor. This can perform by providing a sensor detecting an element which is different between the surface of platen roller and the surface of the roll sheet 3, such as color. In this case, it becomes unnecessary to form the detection mark 49 at the time of printing on the 1st surface of the roll sheet 3. Moreover, the arrangement of a sensor can be set variously in this case as well as the above.

In FIG. 7(*e*), the surface (the 1st surface) previously printed of the roll sheet 3 touches the platen roller 13 in the position of the thermal head 11. Another surface (the 2nd surface) of the roll sheet 3 faces the thermal head 11 and becomes a surface to be printed. Therefore, duplex printing is attained.

Moreover, near the both sides of the thermal head 11, the roll sheet 3 is nipped by the platen roller 13 and the nip roller 15.

Moreover, search is performed so that one end of the domain of the color material layer of Y (yellow) of the thermal transfer sheet 7 comes to the position of the thermal head 11, with conveyance of the roll sheet 3. Here, this one end of the domain of the color material layer is opposite to the end at the time of printing on the 1st surface of the roll sheet 3 (FIG. 7(*a*)), as shown in FIG. 7(*e*). This is for matching with a next print direction.

Subsequently, the thermal head 11 presses the bottom surface (surface in which the color material layer is provided) of the thermal transfer sheet 7 to the top surface (the 2nd surface) of the roll sheet 3. That is, the thermal transfer sheet 7 and the roll sheet 3 are superimposed and pressed between the thermal head 11 and the platen roller 13 in such a manner that the bottom surface of the thermal transfer sheet 7 touches the top surface of the roll sheet 3.

Then, the image corresponding to the amount of Y (yellow) ingredients of the image to print is transferred by a thermal transfer method, with conveying the roll sheet 3 in the direction of the arrow 63 and conveying the thermal transfer sheet 7 in the direction of the arrow 64.

However, conveyance direction of the roll sheet 3 and the thermal transfer sheet 7 at the time of transfer can be opposite to the direction which is shown in FIG. 7(*e*). In this case, when search of the thermal transfer sheet 7 is performed, one end of the domain of the color material layer to be aligned with the thermal head 11 is the same as the end at the time of printing on the 1st surface of the roll sheet 3 (FIGS. 7(*a*)).

The roll sheet 3 is pulled back after transferring the color material of Y (yellow) to the roll sheet 3, until the sensor 17 detects the detection mark 49 again. At this time, the printing starting position of the first printing image of the top surface (the 2nd surface) of the roll sheet 3 comes to the position of the thermal head 11 again.

Printing is performed in the same procedure with changing the color material to transfer to M (magenta) or C (cyan). When transfer of the color material of each color etc. is performed, one image is printed on the top surface (the 2nd surface) of the roll sheet 3.

When one image is printed, the roll sheet 3 is conveyed until the sensor 17 detects the next detection mark 49. Since alignment of the printing starting position of the following printing image and the thermal head 11 is performed when the sensor 17 detects the next detection mark 49, subsequently the following picture is printed in the same procedure.

However, as mentioned above, printing of image can be performed for every sheet, and in this case, after printing one image on the top surface (the 2nd surface) of the roll sheet 3, the procedure shifts to cut the roll sheet 3.

As explained above, alignment of the images to print on both sides at the time of printing is performed by detecting the detection mark 49 by the sensor 17. This prevents misalignment of the images to print on both sides of the roll sheet 3.

In addition, as mentioned previously, it is also possible to print the detection mark 49 in advance on the roll sheet 3, and in this case, it is desirable that, not only when printing on the 2nd surface of the roll sheet 3 mentioned above, but when printing on the 1st surface of the roll sheet 3, a printing starting position is defined by a sensor. That is, when a sensor detects the predetermined detection mark 49 printed in advance, or after conveying predetermined quantity after a sensor detects the detection mark 49, the printing starting position of the printing image of the roll sheet 3 comes to the position of the thermal head 11. In this way, at the time of printing on the 1st surface of the roll sheet 3, the position of a printing image can be defined more correctly. As a result, alignment of the images to print on both sides can be performed more correctly. It is also the same as when using the sensor which detects the tip of the roll sheet 3. Also about these cases, the arrangement of the sensor can be determined variously, as mentioned above.

Thus, after printing a predetermined number of images on the top surface (the 2nd surface) of the roll sheet 3 and completing duplex printing, as shown in FIG. 7(*f*), the cutter 5 cuts the roll sheet 3 according to the domain where the image was printed. In addition, according to the quantity of the printed image, the roll sheet 3 can be cut after pulling back the roll sheet 3.

As explained above, according to the 2nd embodiment of the present invention, the duplex printing method etc. which prints on both sides of roll sheet by a thermal transfer method can be provided.

Moreover, since the roll sheet 3 is conveyed with nipped by the nip roller 15 and the platen roller 13 at the time of printing, conveyance can be ensured. In addition, unevenness is not formed on the surface of the roll sheet 3 by use of the nip roller which has the smooth surface.

Moreover, alignment of the images to print on both sides at the time of printing can be correctly performed by detecting the detection mark 49.

[The 3rd Embodiment]

Then, the 3rd embodiment of the duplex printing method of the present invention will be explained in detail, referring to FIG. 8 and FIG. 9.

Figure 8:
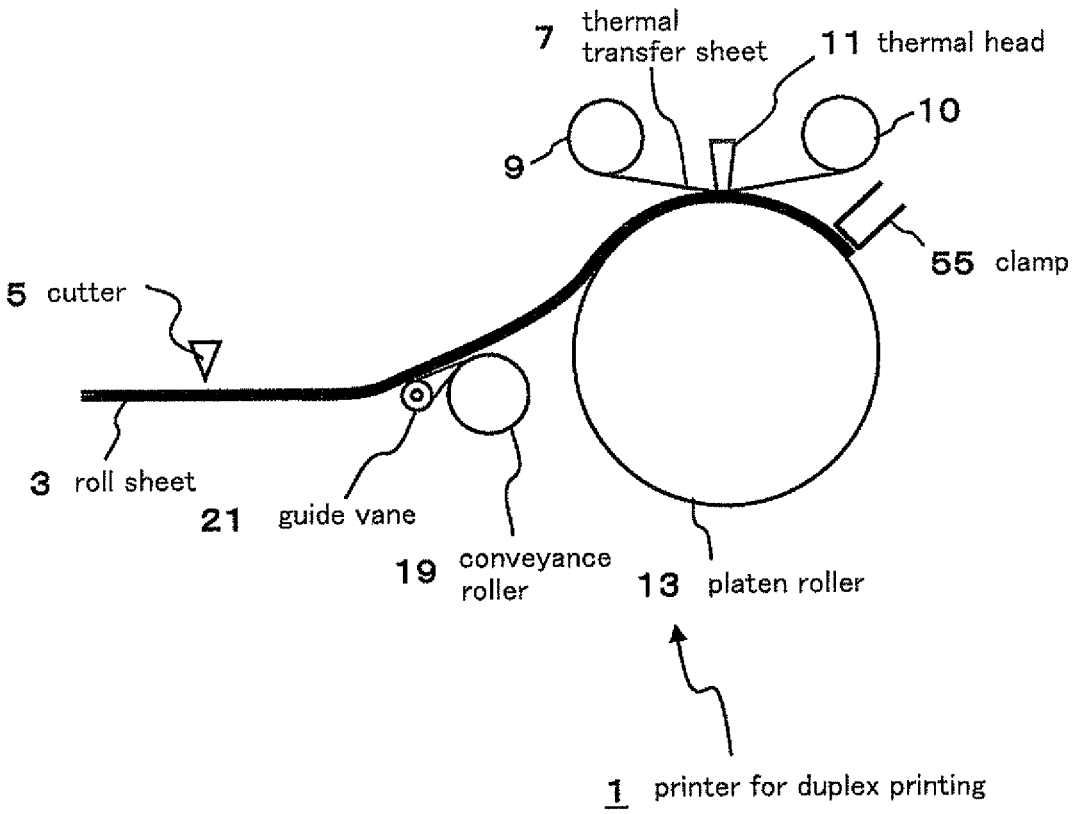

FIG. 8 is a figure showing an example of the printer for duplex printing for performing printing by the duplex printing method of the 3rd embodiment of the present invention.

In the printer for duplex printing 1 shown in FIG. 8, 3 is a roll sheet, 5 is a cutter, 7 is a thermal transfer sheet, 9 is a thermal transfer sheet feed roll, 10 is a thermal transfer sheet rolling-up roll, 11 is a thermal head, 13 is a platen roller, 19 is a conveyance roller, 21 is a guide vane and 55 is a clamp.

In addition, the printer for duplex printing 1 is equipped with the conveyance mechanism of the roll sheet which consists of a roller and a conveyance way etc., and the control part which performs printing control (un-illustrated).

The clamp 55 is equipped with a control part and a rise-and-fall part (un-illustrated) etc., and presses the roll sheet 3 to the platen roller 13. Moreover, at the time of printing, the clamp 55 and the platen roller 13 nips the roll sheet 3 and conveys the roll sheet 3 with holding correctly.

As for the cutter 5, the thermal transfer sheet feed roll 9, the thermal transfer sheet rolling-up roll 10, the thermal head 11, the platen roller 13, the conveyance roller 19, and the guide vane 21 etc., the same thing as explained in the above-mentioned embodiment can be used. Moreover, also as for the thermal transfer sheet 7 and the roll sheet 3, the same thing as explained in the above-mentioned embodiment can be used.

Then, the procedure of the duplex printing method of the 3rd embodiment of the present invention will be explained, referring to FIG. 9.

Figure 9:
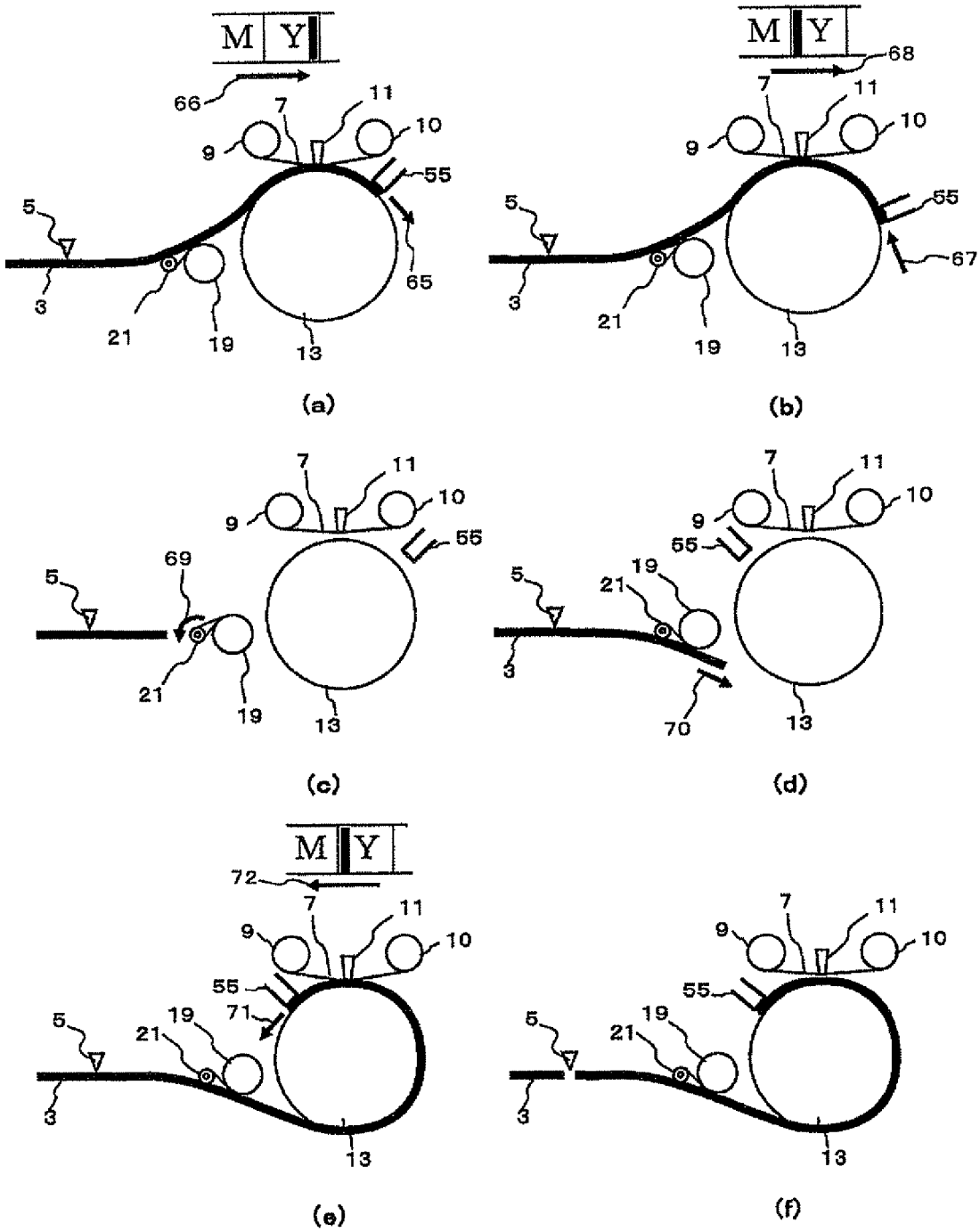
Figure 1:
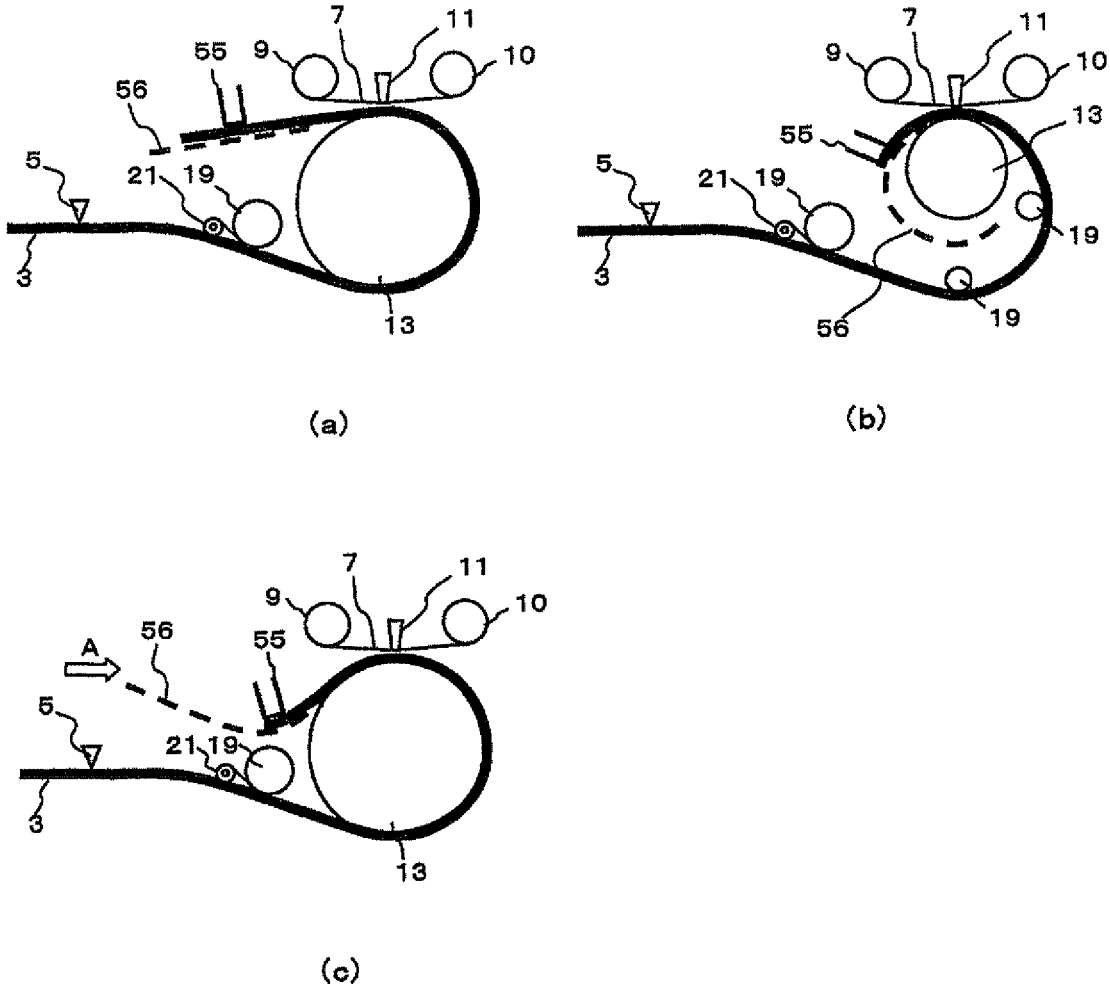
Figure 1:
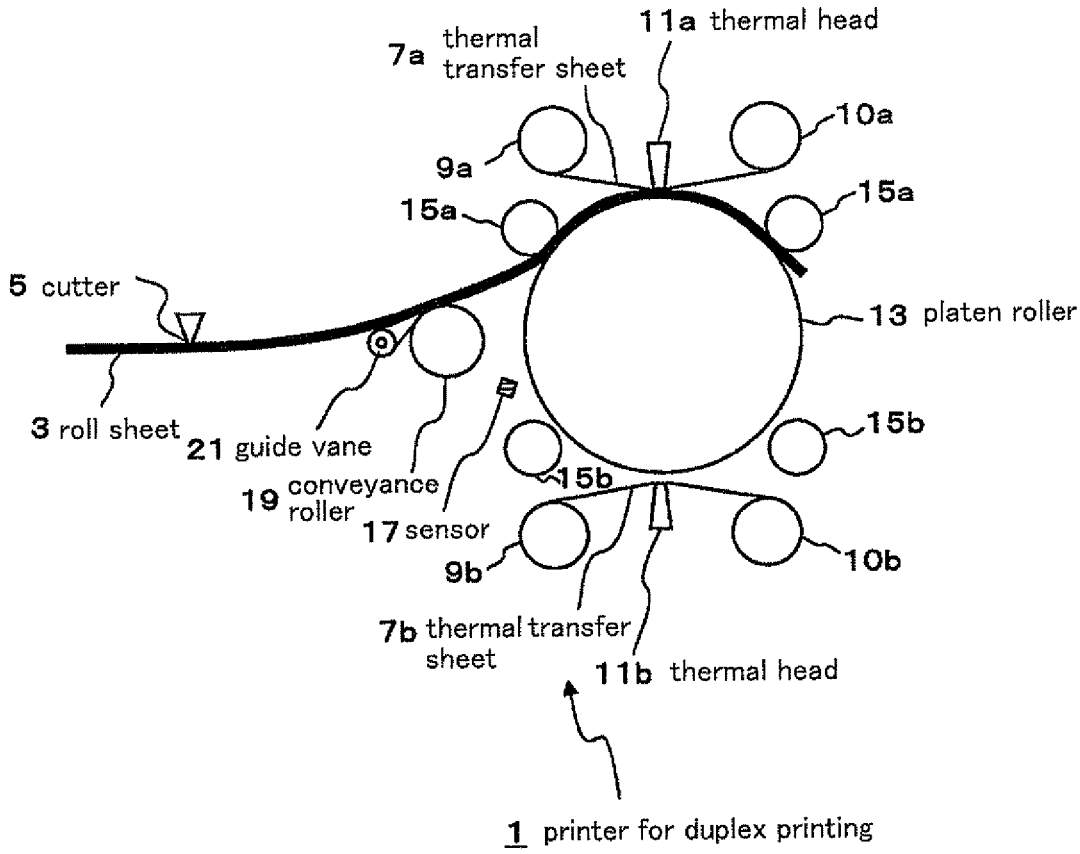
Figure 1:
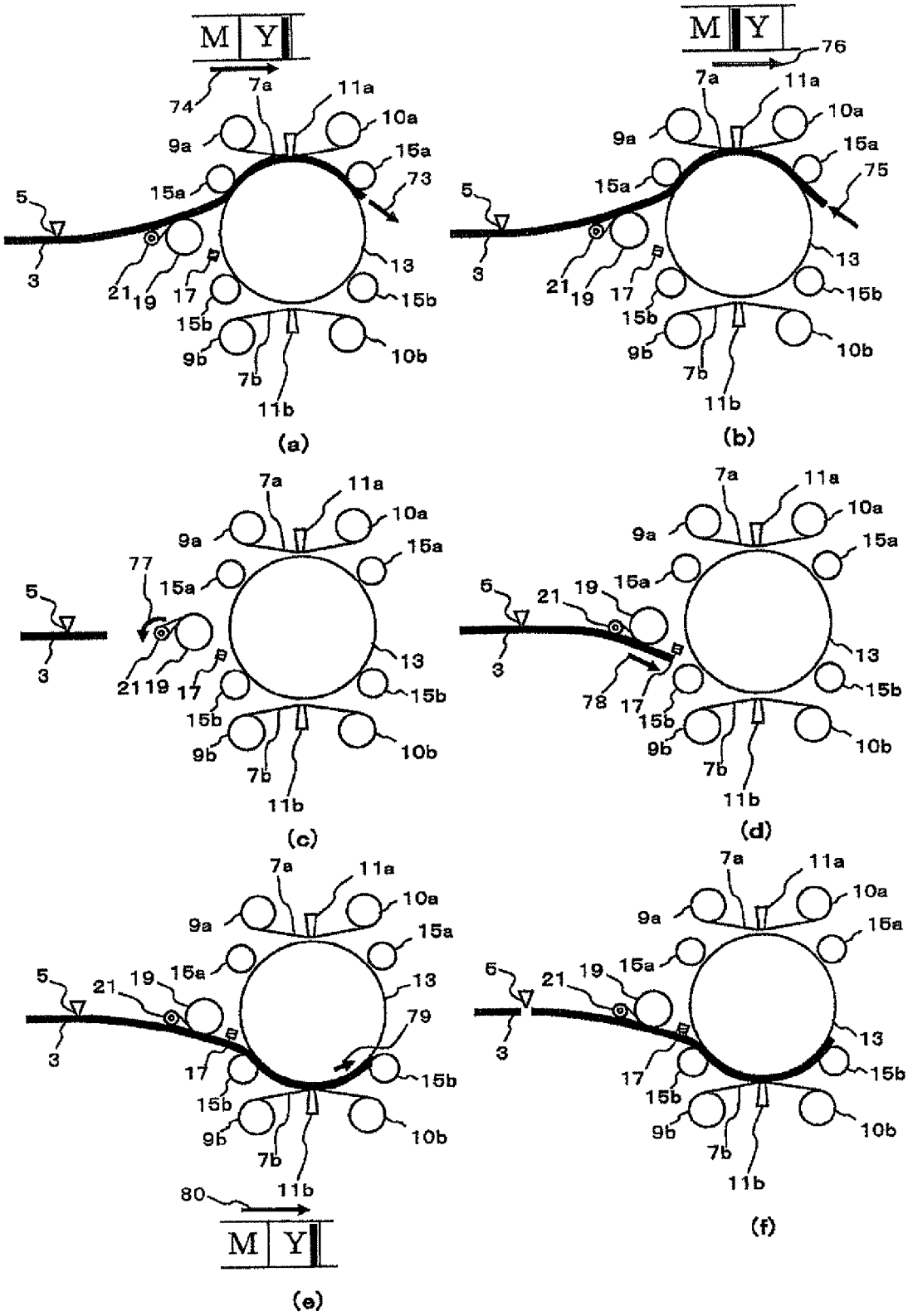
Figure 1:
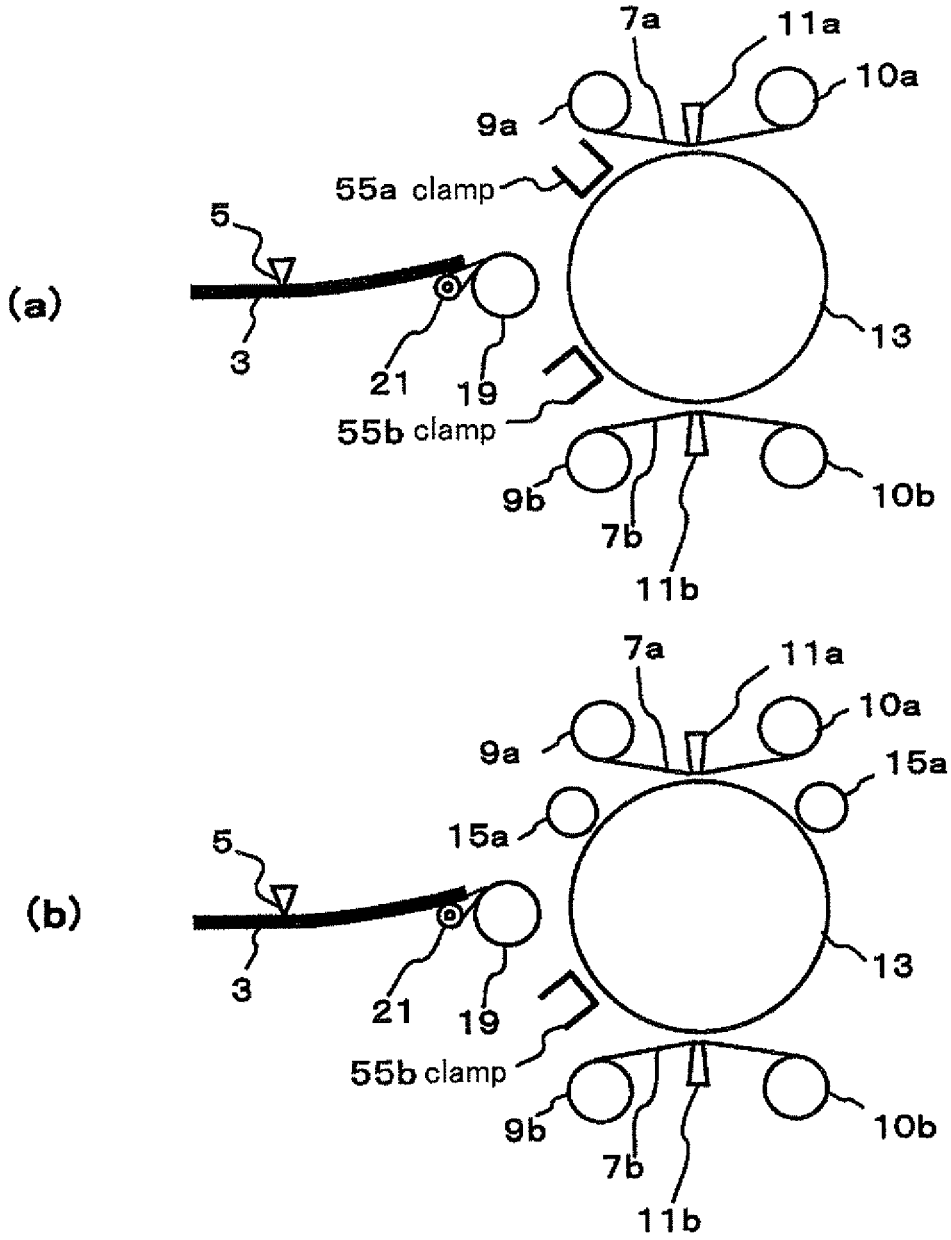
Figure 1:
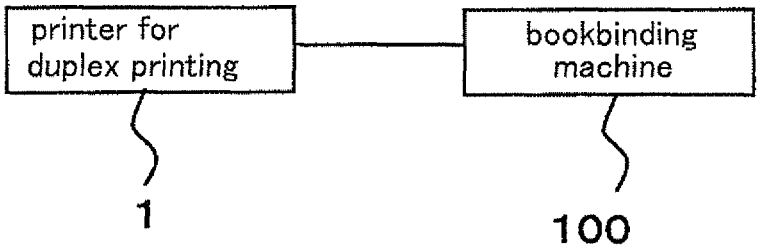
Figure 1:
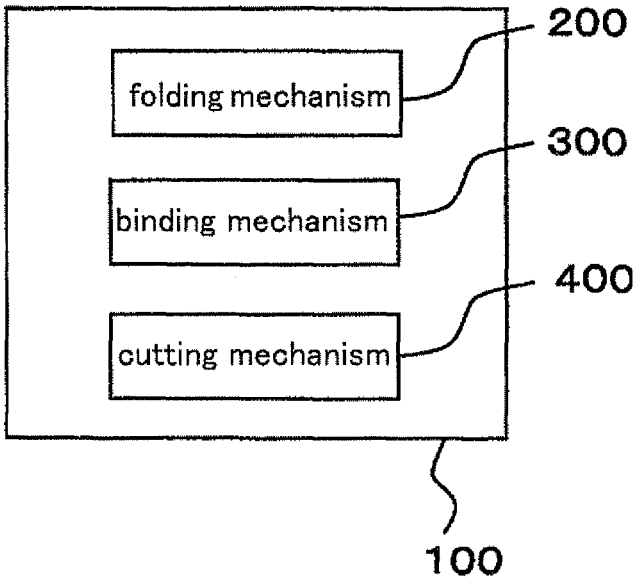
Figure 1:
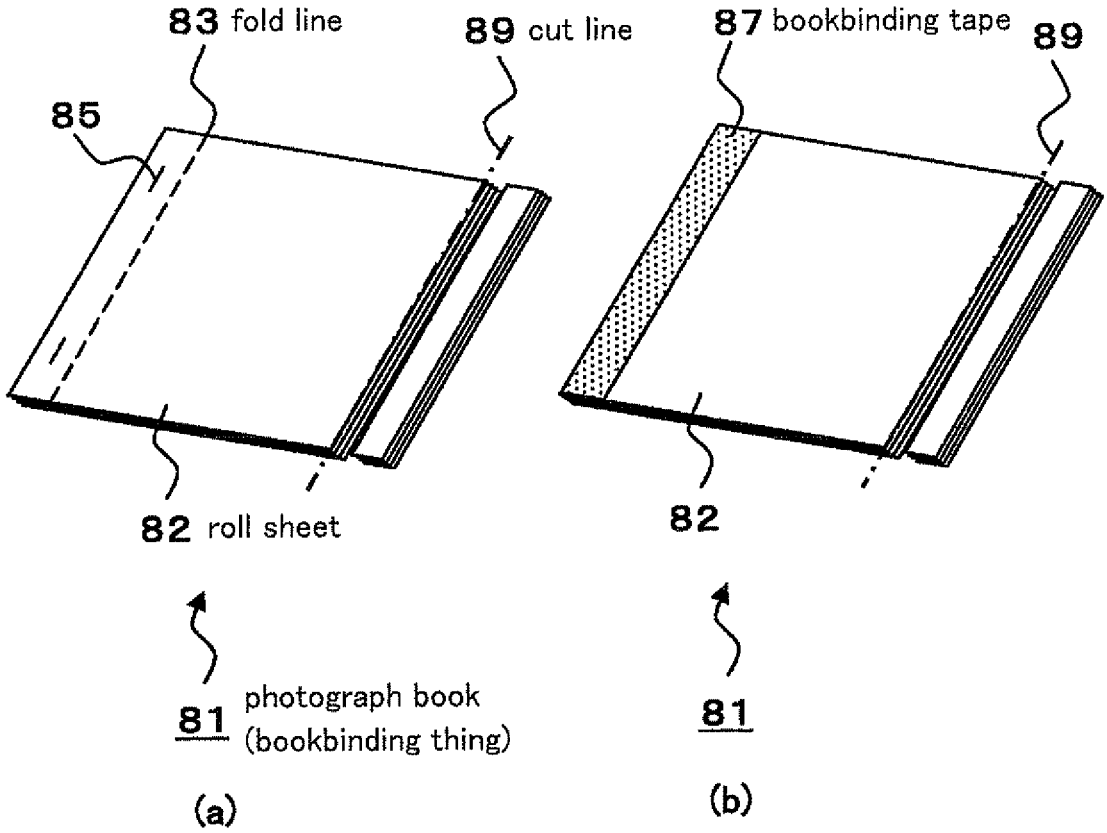
Figure 1:
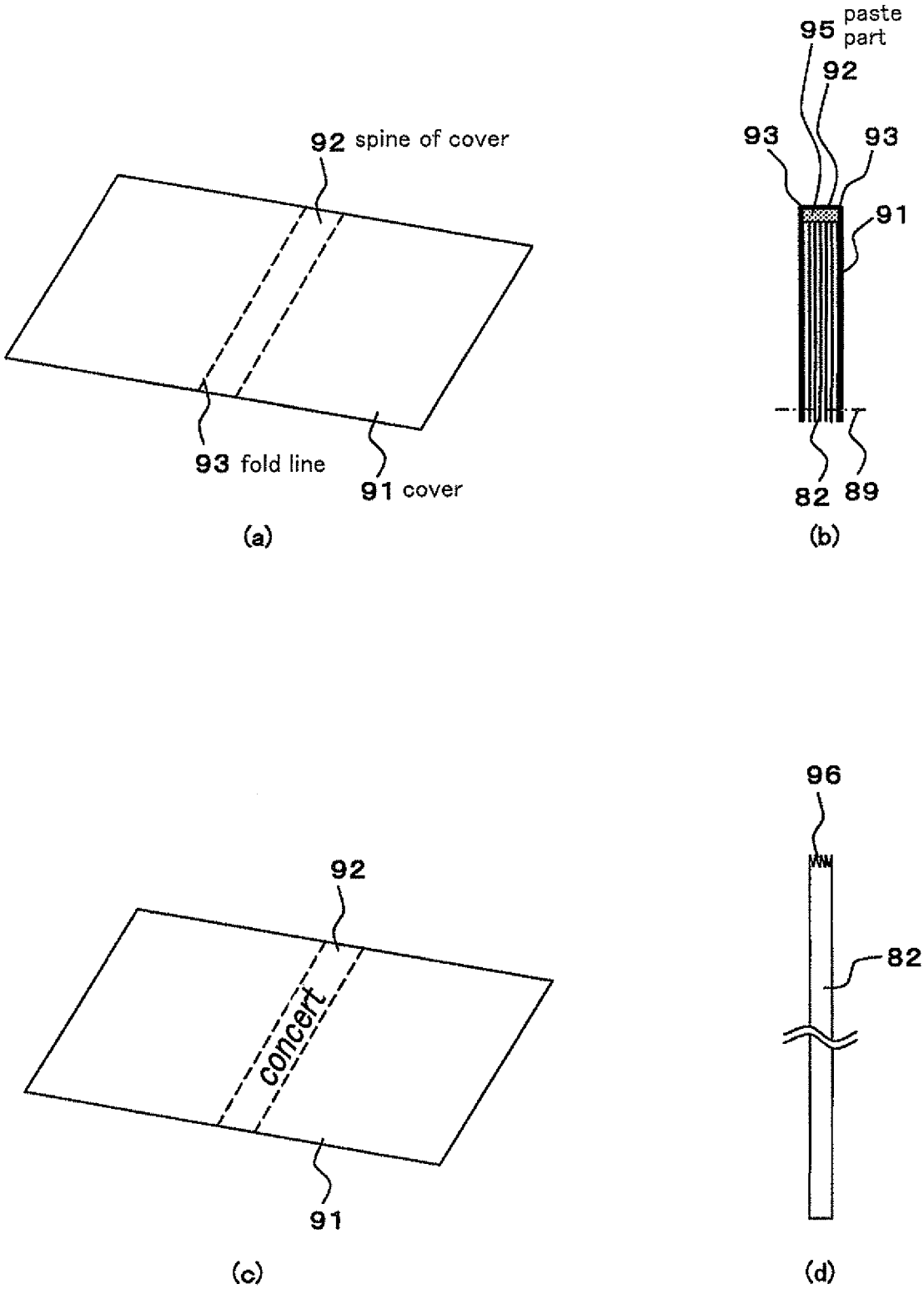
Figure 1:
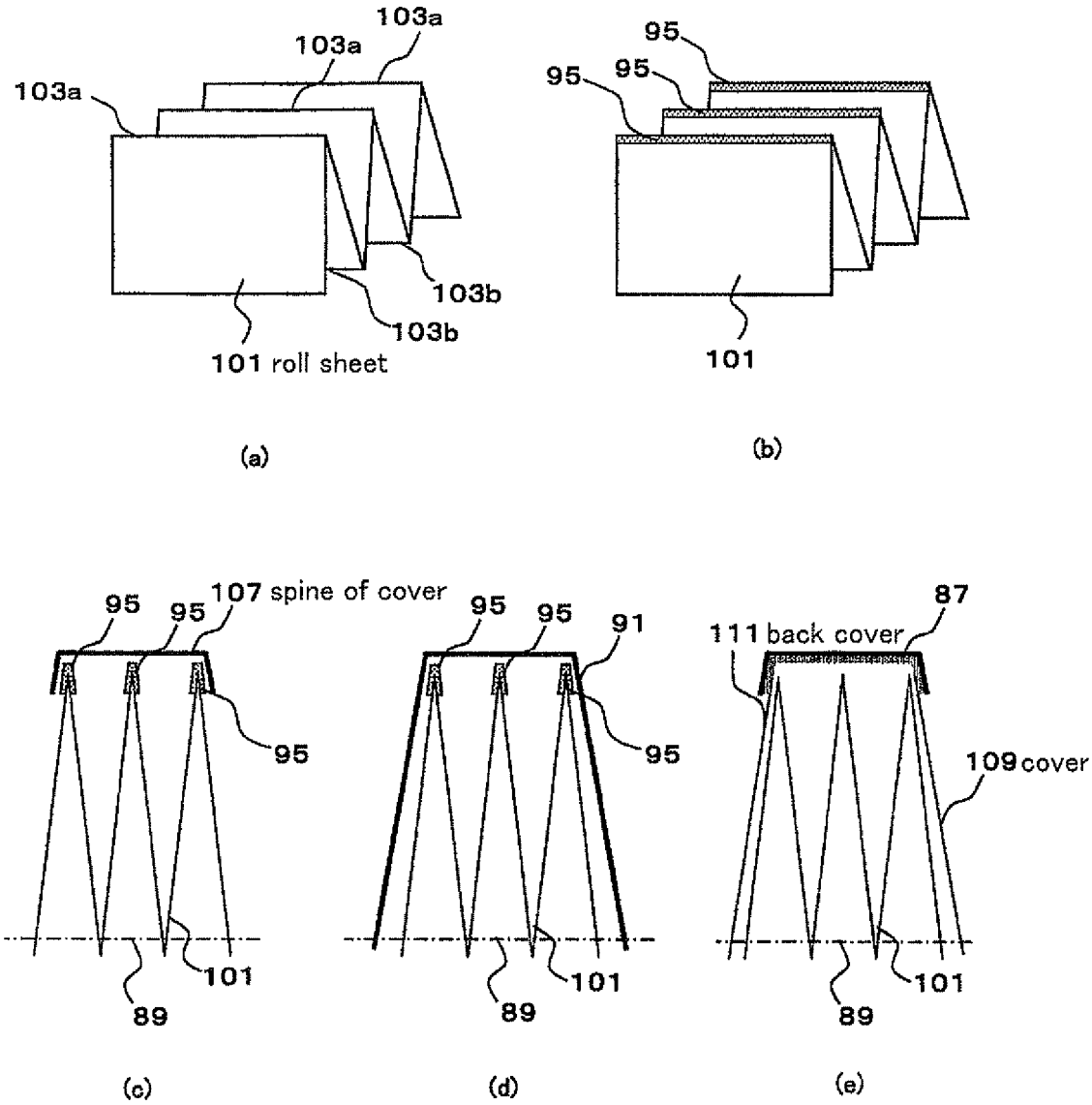
Figure 1:
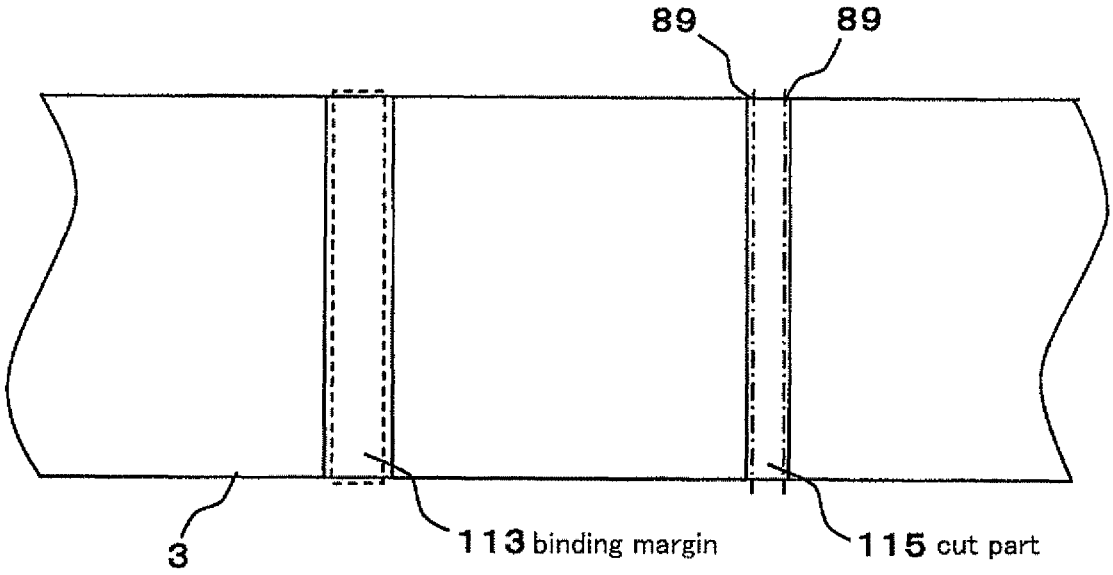
Figure 1:
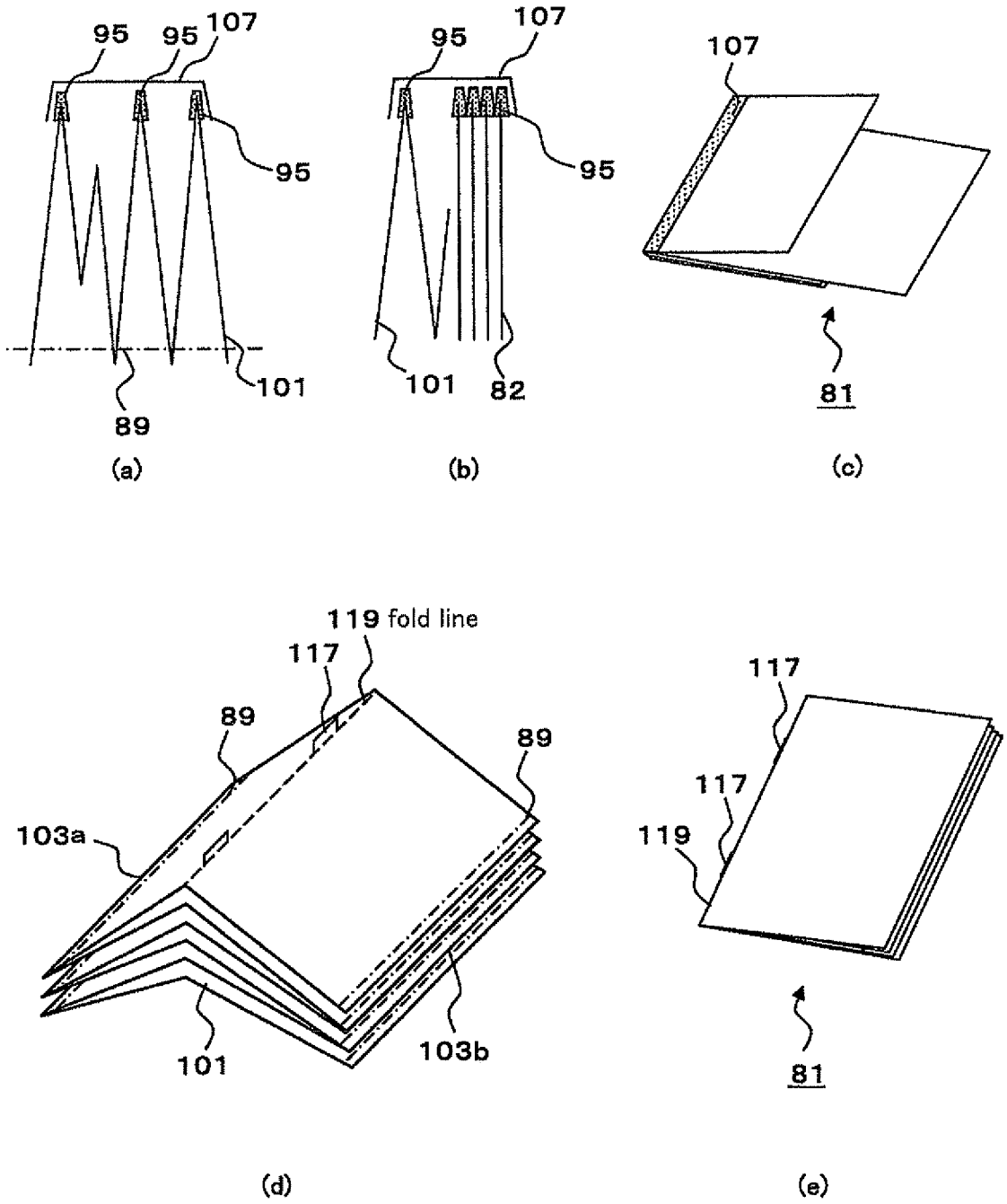

FIG. 9 is a figure showing an example of a procedure which performs duplex printing by the duplex printing method of the 3rd embodiment of the present invention.

The procedure of duplex printing is similar to what was shown in the 2nd embodiment.

First, the roll sheet is conveyed until the printing starting position of the first printing image of the roll sheet 3 comes to the position of the thermal head 11. At the tip of the roll sheet 3, the clamp 55 presses the roll sheet 3 to the platen roller 13 and nips the roll sheet 3.

Moreover, search is performed so that one end of the domain of the color material layer of Y (yellow) of the thermal transfer sheet 7 comes to the position of the thermal head 11.

In addition, at the time of conveyance of the roll sheet 3, the guide vane 21 is set to turn upward and the roll sheet 3 is conveyed above the conveyance roller 19 along with the guide vane 21.

This state is FIG. 9(*a*).

Subsequently, the thermal transfer sheet 7 and the roll sheet 3 is pressed by the thermal head 11 and the platen roller 13, the color material of Y (yellow) is transferred to the top surface (the 1st surface) of the roll sheet 3, with conveying the roll sheet 3 in the direction of the arrow 65 and conveying the thermal transfer sheet 7 in the direction of the arrow 66, respectively.

The state that transfer of the color material of Y (yellow) is finished is FIG. 9(*b*).

Then, the thermal head 11 is raised, and the roll sheet 3 is pulled back in the direction of the arrow 67 with nipped by the clamp 55 and the platen roller 13 by the quantity that roll sheet 3 is conveyed at the time of transfer, so that the printing starting position of the first printing image comes to the position of the thermal head 11 again.

Moreover, the thermal transfer sheet 7 is moved in the direction of the arrow 68 and search is performed so that one end of the domain of the color material layer of M (magenta) comes to the position of the thermal head 11.

Subsequently, printing is performed in the same procedure with changing the color material to transfer to M (magenta) or C (cyan).

When transfer of the color material of each color etc. is performed, one image is printed on the top surface (the 1st surface) of the roll sheet 3.

Thus, after printing of one image is completed, the roll sheet 3 is conveyed with nipped by the clamp 55 until the printing starting position of the following printing image comes to the position of the thermal head 11. Subsequently, the following image is printed in the same procedure.

However, printing of image can be performed for every sheet, and in this case, a procedure of duplex printing is that, after printing one image on the top surface (the 1st surface) of the roll sheet 3, the roll sheet 3 is pulled back from the platen roller 13 and the conveyance direction is changed, then the roll sheet 3 is sent out toward the platen roller 13, and printing on the 2nd surface of the roll sheet 3 is performed.

Thus, after printing a predetermined number of images, the clamp 55 is raised, the roll sheet 3 is pulled back as shown in FIG. 9(*c*) and the tip of the roll sheet 3 is separated from the platen roller 13, then the guide vane 21 is rotated as shown in the arrow 69 to incline downward, and the conveyance course of the roll sheet 3 toward the platen roller 13 is changed below.

Then, as shown in FIG. 9(*d*), the roll sheet 3 is sent out toward the platen roller 13. At this time, the guide vane 21 turns downward and the roll sheet 3 is conveyed in the direction of the arrow 70 under the conveyance roller 19 along with the guide vane 21.

Furthermore, the roll sheet 3 is conveyed with twisted around the platen roller 13 so that the surface previously printed (the 1st surface) touches the platen roller 13. The roll sheet 3 of predetermined quantity is conveyed so that the printing starting position of the first printing image of the roll sheet 3 comes to the position of the thermal head 11.

The state that the roll sheet 3 is conveyed is shown in FIG. 9(*e*).

The predetermined quantity that the roll sheet 3 is conveyed can be determined according to quantity of the roll sheet 3 pulled back previously or a conveyance course etc.

In FIG. 9(*e*), the surface previously printed (the 1st surface) of the roll sheet 3 touches the platen roller 13 in the position of the thermal head 11. Another surface (the 2nd surface) of the roll sheet 3 faces the thermal head 11 and becomes a surface to be printed. Therefore, duplex printing is attained.

Moreover, near the thermal head 11, the tip of the roll sheet 3 is nipped by the platen roller 13 and the clamp 55.

Moreover, search is performed so that one end of the domain of the color material layer of Y (yellow) of the thermal transfer sheet 7 comes to the position of the thermal head 11, with conveyance of the roll sheet 3.

Here, this one end of the domain of the color material layer is opposite to the end at the time of printing on the 1st surface of the roll sheet 3 (FIG. 9(*a*)), as shown in FIG. 9(*e*). This is for matching with a next print direction.

Subsequently, the thermal head 11 presses the bottom surface (surface in which the color material layer is provided) of the thermal transfer sheet 7 to the top surface (the 2nd surface) of the roll sheet 3. That is, the thermal transfer sheet 7 and the roll sheet 3 are superimposed and pressed between the thermal head 11 and the platen roller 13 in such a manner that the bottom surface of the thermal transfer sheet 7 touches the top surface of the roll sheet 3.

Then, the image corresponding to the amount of Y (yellow) ingredients of the image to print is transferred by a thermal transfer method, with conveying the roll sheet 3 in the direction of the arrow 71 and conveying the thermal transfer sheet 7 in the direction of the arrow 72.

However, conveyance direction of the roll sheet 3 and the thermal transfer sheet 7 at the time of transfer can be opposite to what shown in FIG. 9(*e*). In this case, when search of the thermal transfer sheet 7 is performed, one end of the domain of the color material layer to be matched with the thermal head 11 is the same end as the time of printing on the 1st surface of the roll sheet 3 (FIG. 9(*a*)).

After transferring the color material of Y (yellow) to the roll sheet 3, the roll sheet 3 is pulled back only by the quantity that the roll sheet 3 is conveyed at the time of transfer with nipped by the clamp 55 and the platen roller 13. At this time, the printing starting position of the first printing picture of the top surface (the 2nd surface) of the roll sheet 3 comes to the position of the thermal head 11 again.

Subsequently, printing is performed in same procedure with changing the color material to transfer to M (magenta) or C (cyan). When transfer of the color material of each color etc. is performed, one image is printed on the top surface (the 2nd surface) of the roll sheet 3.

After one image is printed, the roll sheet 3 is conveyed by predetermined quantity with nipped by the clamp 55 so that the printing starting position of the following printing image comes to the position of the thermal head 11, and the following image is printed in the same procedure.

However, as mentioned above, printing can be performed for every sheet, and in this case, after printing one image on the top surface (the 2nd surface) of the roll sheet 3, the procedure shifts to cut the roll sheet 3.

Thus, after printing a predetermined number of images on the top surface (the 2nd surface) of the roll sheet 3 and completing duplex printing, as shown in FIG. 9(*f*), the cutter 5 cuts the roll sheet 3 according to the domain where the image is printed. In addition, according to the quantity of the printed images, the roll sheet 3 can be cut after pulling back the roll sheet 3.

In addition, when nipping and conveying the roll sheet 3 by the clamp 55 and the platen roller 13, the number of the images which can be printed while conveying the roll sheet 3 in one direction depends on the length of the portion that the roll sheet 3 does not touch of the perimeter of the platen roller 13. For example, comparing the case of FIG. 9(*a*) which prints on the 1st surface of the roll sheet 3 with the case of FIG. 9(*e*) which prints on the 2nd surface of the roll sheet 3, the length of the portion that the roll sheet 3 does not touch of the perimeter of the platen roller 13 is shorter in the case of FIG. 9(*e*), and the number of the images which can be printed while conveying the roll sheet 3 in one direction decreases. For example, as shown in FIG. 9(*e*), in the case of printing on the 2nd surface of the roll sheet 3 etc., when the length of the portion that the roll sheet 3 does not touch of the perimeter of the platen roller 13 is shorter than the length that the roll sheet 3 is conveyed and printed at the time of printing (corresponding to the number of images to print), in order to compensate this, conveyance ways prolonged from the platen roller 13 to outside along the conveyance direction of the roll sheet 3, such as a rail, can be provided further and the roll sheet 3 can be nipped and conveyed by the clamp 55 and this conveyance way at the time of printing. By providing such a conveyance way, the flexibility of conveyance of the roll sheet 3 increases and shortage of the conveyance length at the time of the printings as mentioned above can be compensated.

For example, this conveyance way can be formed as the conveyance way 56 which extends from the platen roller 13 to outside along the conveyance direction of the roll sheet 3 at the time of printing, as shown in FIG. 10(*a*). Or as shown in FIG. 10(*b*), by making the platen roller 13 small and combining the conveyance roller 19 etc., space is made between the roll sheet 3 and the platen roller 13 except near the thermal head 11 (when printing on the 2nd surface of the roll sheet 3), and the conveyance way 56 which extends from the platen roller 13 along the conveyance direction of the roll sheet 3 and reaches the space can also be formed. This conveyance way 56 is a conveyance way which conveys the roll sheet 3 in a spiral conveyance course at the time of printing and space-saving of the printer for duplex printing 1 can be attained. Moreover, at the time of printing on the roll sheet 3, the roll sheet 3 is nipped and conveyed by the clamp 55 and the platen roller 13 until predetermined conveyance length, and over predetermined conveyance length, as shown in FIG. 10(*c*), the conveyance course of the roll sheet 3 is changed to the conveyance way 56, for example, by moving the conveyance way 56 in the direction toward the platen roller 13 shown by the arrow A by a change mechanism (un-illustrated), and the roll sheet 3 can be nipped and conveyed henceforth by the clamp 55 and the conveyance way 56. Predetermined conveyance length can be the length of the portion that the roll sheet 3 does not touch of the perimeter of the platen roller 13, or arbitrary length shorter than this, for example. And a change to the conveyance way 56 can be controlled by a control part (un-illustrated).

Of course, in the case of printing on the 1st surface etc., when conveyance length does not run short, the roll sheet 3 can be conveyed with nipped by the platen roller 13 and the clamp 55.

In addition, in above example, the conveyance way which conveys the roll sheet 3 by the clamp 55 when printing on the 2nd surface of the roll sheet 3 (FIG. 9(*e*) etc.) is explained, but the above example can be applied even when conveying at time of printing on the 1st surface (FIG. 9(*a*) etc.).

That is, when conveyance length runs short at the time of printing on the 1st surface of the roll sheet 3, the roll sheet 3 can be nipped by the clamp 55 and the conveyance way which is provided to extend along the conveyance direction at the time of printing on the 1st surface of the roll sheet 3, and when conveyance length does not run short at the time of printing on the 2nd surface, the roll sheet 3 can be nipped by the platen roller 13 and the clamp 55, and when conveyance length runs short at the time of printing on the 1st and 2nd surface, in both of the case, the roll sheet 3 can be nipped by the clamp 55 and the above-mentioned conveyance way. It is also the same as when changing a conveyance course. Moreover, this is possible to apply also when the roll sheet 3 is conveyed with nipped by a nip roller and the above-mentioned conveyance way.

As explained above, according to the 3rd embodiment of the present invention, the duplex printing method etc. which prints on both sides of roll sheet by a thermal transfer method can be provided.

Moreover, at the time of printing, since the roll sheet 3 is more correctly and strongly nipped by the clamp 55 and the platen roller 13 etc. and conveyed, misalignment of the roll sheet 3 can be prevented at the time of conveyance, and alignment can be performed correctly by control of the amount of conveyances.

[The 4th Embodiment]

Based on FIG. 11 and FIG. 12, the 4th embodiment of the duplex printing method of the present invention will be explained in detail below.

FIG. 11 is a figure showing an example of the printer for duplex printing for performing printing by the duplex printing method of the 4th embodiment of the present invention.

In the printer for duplex printing 1 of FIG. 11, 3 is a roll sheet, 5 is a cutter, 7*a* (7*b*) is a thermal transfer sheet, 9*a* (9*b*) is a thermal transfer sheet feed roll, 10*a* (10*b*) is a thermal transfer sheet rolling-up roll, 11*a*(11*b*) is a thermal head, 13 is a platen roller, 15*a* (15*b*) is a nip roller, 17 is a sensor, 19 is a conveyance roller and 21 is a guide vane.

In addition, the printer for duplex printing 1 is equipped with the conveyance mechanism of the roll sheet 3 which consists of a roller and a conveyance way etc., and the control part which performs printing control (un-illustrated).

In FIG. 11, the sensor 17 is arranged between the conveyance roller 19 and the nip roller 15*b*. However, as mentioned later, the position of the sensor 17 is not restricted to this and the sensor 17 can be provided inside the platen roller 13 near the thermal head 11*b* at the lower stream side of print direction, for example.

As for the cutter 5, the thermal transfer sheet feed roll 9*a* (9*b*), the thermal transfer sheet rolling-up roll 10*a* (10*b*), the thermal head 11*a* (11*b*), the platen roller 13, the nip roller 15*a* (15*b*), the sensor 17, the conveyance roller 19, and the guide vane 21 etc., the same thing as explained in the above-mentioned embodiment can be used. Moreover, also as for the thermal transfer sheet 7*a* (7*b*) and the roll sheet 3, the same thing as explained in the above-mentioned embodiment can be used.

Then, the flow of the duplex printing method of this embodiment will be explained, referring to FIG. 12.

FIG. 12 is a figure showing an example of a procedure which performs duplex printing by the duplex printing method of this embodiment.

At the time of the start of duplex printing, at first, search is performed so that one end of the domain in which the color material layer of Y (yellow) is provided of the thermal transfer sheet 7*a* comes to the position of the thermal head 11*a*.

In addition, the roll sheet 3 is sent out by conveyance roller 19 etc. so that the printing starting position of the first printing image of the roll sheet 3 comes to the position of the thermal head 11*a* above the platen roller 13. At this time, the guide vane 21 arranged to turn upward, and the roll sheet 3 is sent out above the conveyance roller 19 along with the guide vane 21.

Moreover, near the both sides of the thermal head 11*a*, the roll sheet 3 is nipped by the platen roller 13 and the nip roller 15*a*. In the position of the thermal head 11*a*, the bottom surface (the 2nd surface) of the roll sheet 3 touches the platen roller 13, and the top surface (the 1st surface) of the roll sheet 3 faces the thermal head 11*a*.

Since the roll sheet 3 is nipped by the platen roller 13 and the nip roller 15*a*, conveyance of the roll sheet 3 can be ensured.

Subsequently, the thermal head 11*a* presses the bottom surface (surface in which the color material layer is provided) of the thermal transfer sheet 7*a* to the top surface (the 1st surface) of the roll sheet 3.

That is, the thermal transfer sheet 7*a* and the roll sheet 3 are superimposed and pressed between the thermal head 11*a* and the platen roller 13 in such a manner that the bottom surface of the thermal transfer sheet 7*a* touches the top surface of the roll sheet 3.

The state which is shown above is shown in FIG. 12(*a*).

Then, the image corresponding to the amount of Y (yellow) ingredients of the image to print is transferred by a thermal transfer method, with conveying the roll sheet 3 in the direction of the arrow 73 and conveying the thermal transfer sheet 7*a* in the direction of the arrow 74, respectively.

That is, the heat generation element of the heat generation part of the thermal head 11*a* generates heat according to the amount of Y (yellow) ingredients of image data, and the color material of Y (yellow) of the thermal transfer sheet 7*a* is transferred to the top surface (the 1st surface) of the roll sheet 3 only by the quantity according to the amount of Y (yellow) ingredients of image data.

The state after transferring the color material of Y (yellow) in this way is FIG. 12(*b*).

After finishing transfer of the color material of Y (yellow), the thermal head 11*a* is raised, the thermal transfer sheet 7*a* is separated from the roll sheet 3, and the roll sheet 3 is pulled back in the direction shown in the arrow 75. The quantity that the roll sheet 3 is pulled back is the same as the quantity that the roll sheet 3 is conveyed at the time of transfer, and the printing starting position of the first printing image comes to the same position as the thermal head 11*a* again.

Moreover, the thermal transfer sheet 7*a* is conveyed in the direction of the arrow 39 and search is performed so that one end of the domain of the color material layer of M (magenta) of the thermal transfer sheet 7*a* comes to the position of the thermal head 11*a*.

Then, the color material of M (magenta) and C (cyan) is transferred according to the amount of ingredients of each color of image data in the same procedure. Moreover, according to the printing purpose, transfer of a color material of K (black), gold and silver, a hologram, and a protection layer etc. can be performed.

When the color material of each color etc. are transferred according to image data and one image is printed on the top surface (the 1st surface) of the roll sheet 3 in this way, the roll sheet 3 is conveyed by predetermined quantity so that the printing starting position of the following printing image comes to the position of the thermal head 11*a*, and an image is printed in the same procedure.

However, printing of image can be performed for every sheet, and in this case, the procedure of duplex printing is that, after printing one image on the top surface (the 1st surface) of the roll sheet 3, the roll sheet 3 is pulled back from the platen roller 13 and the conveyance direction is changed, then the roll sheet 3 is sent out toward the platen roller 13, and printing of image on the 2nd surface of the roll sheet 3 is performed.

Moreover, at the time of printing of an image, the detection mark 49 can be formed in the roll sheet 3.

Thus, after printing a predetermined number of images, as shown in FIG. 12(*c*), the roll sheet 3 is pulled back and the tip of the roll sheet 3 is separated from the platen roller 13, then the guide vane 21 is rotated as shown in the arrow 77 to incline downward and the conveyance course of the roll sheet 3 toward the platen roller 13 is changed to below.

Then, as shown in FIG. 12(*d*), the roll sheet 3 is sent out toward the platen roller 13. At this time, the guide vane 21 is arranged to turn downward, and the roll sheet 3 is conveyed in the direction of the arrow 78 under the conveyance roller 19 along with the guide vane 21.

Furthermore, the roll sheet 3 is conveyed with twisted around the platen roller 13 so that the surface previously printed (the 1st surface) of the roll sheet 3 touches the platen roller 13. The roll sheet 3 of predetermined quantity is conveyed so that the printing starting position of the first printing image of the roll sheet 3 comes to the position of the thermal head 11*b*.

The state which the roll sheet 3 is conveyed is shown in FIG. 12(*e*).

Moreover, the sensor 17 detects the detection mark 49 formed in the 1st surface of the roll sheet 3 at this time.

The sensor 17 is arranged between the conveyance roller 19 and the nip roller 15*b* so that the printing starting position of the printing image of the roll sheet 3 comes to the position of the thermal head 11*b* when detecting the predetermined detection mark 49 by the sensor 17. Thus, alignment of the images to print on both sides is performed. At this time, by detection of the detection mark 49 of the domain different from the domain to be printed, alignment of printing can be performed. Moreover, the position of the sensor 17 is not restricted to what is shown in FIG. 11 or FIG. 12(*e*), and for example, the sensor 17 can be fixed inside of the platen roller 13 whose surface is constructed by a transparent member, near the thermal head 11*b* at lower stream side of the print direction. At this time, the detection mark 49 formed previously can be detected by the sensor 17 arranged inside of the platen roller 13. This is applicable also in the above-mentioned embodiment.

Moreover, the sensor 17 can be arranged so that the printing starting position of the printing image of the roll sheet 3 separates from the position of the thermal head 11*b* by predetermined quantity when detecting the detection mark 49 by the sensor 17. In this case, alignment of images to print on both sides is performed by pulling back or sending out the roll sheet 3 by predetermined quantity after detecting the detection mark 49 by the sensor 17.

Moreover, using the sensor detecting the tip of the roll sheet 3 instead of the sensor 17, conveyance control (alignment of images to print on both sides) of the roll sheet 3 can be performed by detecting the tip of the roll sheet 3 by this sensor. This can be performed by providing the sensor detecting an element which is different between the surface of the platen roller 13 and the surface of the roll sheet 3, such as color, for example. In this case, when printing on the top surface (the 1st surface) of the roll sheet 3, it is unnecessary to form the detection mark 49.

Moreover, the arrangement of a sensor can be set variously in this case as well as the above.

In FIG. 12(*e*), at the position of the thermal head 11*b*, the surface previously printed (the 1st surface) of the roll sheet 3 touches the platen roller 13. Another surface (the 2nd surface) of the roll sheet 3 faces the thermal head 11*b* and becomes a surface to be printed. Therefore, duplex printing is attained.

Moreover, near the both sides of the thermal head 11*b*, the roll sheet 3 is nipped by the platen roller 13 and the nip roller 15*b*.

Moreover, search is performed so that one end of the domain of the color material layer of Y (yellow) of the thermal transfer sheet 7*b* comes to the position of the thermal head 11*b*, with conveyance of the roll sheet 3.

Subsequently, the thermal head 11*b* presses the top surface (surface in which the color material layer is provided) of the thermal transfer sheet 7*b* to the bottom surface (the 2nd surface) of the roll sheet 3. That is, the thermal transfer sheet 7*b* and the roll sheet 3 are superimposed and pressed between the thermal head 11*b* and the platen roller 13 in such a manner that the top surface of the thermal transfer sheet 7*b* touches the bottom surface of the roll sheet 3.

Then, the image corresponding to the amount of Y (yellow) ingredients of the image to print is transferred by a thermal transfer method, with conveying the roll sheet 3 in the direction of the arrow 79 and conveying the thermal transfer sheet 7*b* in the direction of the arrow 80.

The roll sheet 3 is pulled back after transferring the color material of Y (yellow) to the roll sheet 3 until the sensor 17 detects the detection mark 49 again. At this time, the printing starting position of the first printing image of the bottom surface (the 2nd surface) of the roll sheet 3 comes to the position of the thermal head 11*b* again.

Printing is performed in the same procedure with changing the color material to transfer to M (magenta) or C (cyan). When transfer of the color material of each color etc. is performed, one image is printed on the bottom surface (the 2nd surface) of the roll sheet 3.

When one image is printed, the roll sheet 3 is conveyed until the sensor 17 detects the next detection mark 49. Since alignment of the printing starting position of the following printing image and the thermal head 11*b* is performed when the sensor 17 detects the next detection mark 49, subsequently the following picture is printed in the same procedure.

However, as mentioned above, printing of image can be performed for every sheet, and in this case, after printing one image on the bottom surface (the 2nd surface) of the roll sheet 3, the procedure shifts to cut the roll sheet 3.

As explained above, alignment of the images to print on both sides at the time of printing is performed by detecting the detection mark 49 by the sensor 17. This prevents misalignment of the position of the images to print on both sides of the roll sheet 3.

In addition, as previously mentioned, it is also possible to print the detection mark 49 in advance on the roll sheet 3. In this case, not only when printing on the bottom surface (the 2nd surface) of the roll sheet 3 mentioned above, but when printing on the top surface (the let surface) of the roll sheet 3, it is desirable to define a printing starting position by a sensor. That is, when a sensor detects the predetermined detection mark 49 printed in advance, or after conveyance of predetermined quantity is carried out after a sensor detects the detection mark 49, the printing starting position of the printing image of the roll sheet 3 comes to the position of the thermal head 11*a*. In this way, when printing on the top surface (the 1st surface) of the roll sheet 3, the position of printing image can be defined more correctly. As a result, alignment of the images to print on both sides can be performed more correctly. It is also the same as when using the sensor which detects the tip of the roll sheet 3.

Also about these cases, arrangement of the sensor can be determined variously, as mentioned above.

Thus, after printing a predetermined number of images on the bottom surface (the 2nd surface) of the roll sheet 3 and completing duplex printing, as shown in FIG. 12(*f*), the cutter 5 cuts the roll sheet 3 according to the domain where the image is printed. In addition, according to the quantity of the printed images, the roll sheet 3 can be cut after pulling back the roll sheet 3.

As explained above, according to the 4th embodiment of the present invention, the duplex printing method etc. which prints on both sides of roll sheet by a thermal transfer method can be provided.

Moreover, at the time of printing, since the roll sheet 3 is conveyed with nipped by the nip roller 15*a* (15*b*) and the platen roller 13, sure conveyance is possible. In addition, unevenness is not formed on the surface of the roll, sheet 3 by use of the nip roller which has the smooth surface.

Moreover, alignment of the images of both sides at the time of printing can be correctly performed by detecting the detection mark 49.

The roll sheet 3 is conveyed with the thermal transfer sheet 7*a* (7*b*) with nipped by the nip roller 15*a* (15*b*) at the time of printing in the duplex printing method of this embodiment, but the method of nipping and conveying the roll sheet 3 at the time of printing is not restricted to this and can also be performed using a clamp. FIG. 13 shows its example.

FIG. 13(*a*) shows what conveyance of the roll sheet 3 is performed with nipping the tip of the roll sheet 3 by a clamp (clamp 55*a*, 55*b*) and the platen roller 13 in both process of printing on the top surface (the 1st surface) of the roll sheet 3 and printing on the bottom surface (the 2nd surface) of the roll sheet 3.

Even in this case, the procedure of printing is almost same as the above-mentioned embodiment performed by nipping the roll sheet 3 by the nip roller 15*a* (15*b*) and the platen roller 13. When printing on the top surface (the 1st surface) of the roll sheet 3, the roll sheet 3 is conveyed with nipped by the clamp 55*a* and the platen roller 13, and when printing on the bottom surface (the 2nd surface) of the roll sheet 3, the roll sheet 3 is conveyed with nipped by the clamp 55*b* and the platen roller 13. When nipping the roll sheet 3 by a clamp (clamp 55*a*, 55*b*), since the roll sheet 3 can be more correctly held, alignment of printing images of both sides can be correctly performed only by control of the amount of conveyances.

Therefore, it is not required to use the sensor 17 about alignment of printing images of both sides and the sensor 17 is not required as composition of the printer for duplex printing 1. Furthermore, when printing on the top surface (the 1st surface) of the roll sheet 3, it is also unnecessary to form the detection mark 49.

Moreover, two clamps are not necessarily and same clamp can be used to hold the roll sheet 3 in both process of printing on the top surface (the 1st surface) of the roll sheet 3 and printing on the bottom surface (the 2nd surface) of the roll sheet 3.

Moreover, FIG. 13(*b*) is what the roll sheet 3 is conveyed with nipped by the nip roller 15*a* and the platen roller 13 when printing on the top surface (the 1st surface) of the roll sheet 3, and with nipped at the tip by the clamp 55*b* and the platen roller 13 when printing on the bottom surface (the 2nd surface) of the roll sheet 3.

Even in this case, the procedure of printing is almost same as above-mentioned embodiment performed by nipping the roll sheet 3 by the nip roller 15*a* (15*b*) and the platen roller 13. Moreover, since the roll sheet 3 can be more correctly held by the clamp 55*b* in the process of printing on the bottom surface (the 2nd surface) of the roll sheet 3, alignment of printing images of both sides of the roll sheet 3 can be correctly performed only by control of the amount of conveyances.

Therefore, also in this case, the sensor 17 is not needed and it is unnecessary to form the detection mark 49 when printing on the top surface (the 1st surface) of the roll sheet 3.

Moreover, contrary to this, the roll sheet 3 can be conveyed with nipped at a tip by a clamp and the platen roller 13 when printing on the top surface (the 1st surface) of the roll sheet 3, and with nipped by a nip roller and the platen roller 13 when printing on the bottom surface (the 2nd surface) of the roll sheet 3.

Even in this case, the procedure of printing is almost same as the above-mentioned embodiment performed by nipping the roll sheet 3 by the nip roller 15*a* (15*b*) and the platen roller 13. However, in the process of printing on the bottom surface (the 2nd surface) of the roll sheet 3, in order to perform alignment of images to print on both sides correctly, the sensor 17 is needed and it is necessary to form the detection mark 49 when printing on the top surface (the 1st surface) of the roll sheet 3. However, when the sensor which detects the tip of the roll sheet 3 as mentioned above is used instead of the sensor 17 at this time, it is unnecessary to form the detection mark 49.

When applying the heat to the roll sheet 3 according to the image to print by the thermal head 11*a* (11*b*, 11), by the difference of printing ratio (area in which a color material etc. is transferred) in both sides or the concentration difference of a image, the roll sheet 3 may curl with one surface as an inner side by the heat contraction action of multi-hole polypropylene film 23 etc. In the bookbinding using the roll sheet 3 mentioned later etc., this is not desirable, so a curl reform mechanism (un-illustrated) can be provided in the printer for duplex printing 1 explained in the 1st to 4th embodiment, and curl of the roll sheet 3 printed on both sides and cut by the printer for duplex printing 1 can be removed by this curl reform mechanism. Or before cutting the roll sheet 3 printed on both sides, curl can be removed by a curl reform mechanism. This curl reform mechanism can give stress in the direction which can correct curl, i.e., opposite to direction of curl, and a conveyance mechanism with the conveyance guide and the roller, and the mechanism heating and pressurizing by a roller etc. can be used.

Moreover, the printer for duplex printing 1 and a bookbinding machine can be combined, and bookbinding things, such as a photograph book, can be created using the roll sheet printed by the duplex printing method of the 1st to 4th embodiment. That is, as shown in FIG. 14(*a*), the printer for duplex printing 1 and the bookbinding machine 100 are combined, the roll sheet 3 printed on both sides and cut by the printer for duplex printing 1 is conveyed to the bookbinding machine 100, bookbinding is performed by the bookbinding machine 100, and bookbinding things, such as a photograph book, are created and outputted.

As such a bookbinding machine 100, for example, as shown in FIG. 14(*b*), what is equipped with the folding mechanism 200 which folds roll sheet, the binding mechanism 300 which binds roll sheet by a stapler, a bookbinding tape, a spine of cover, and paste etc., and the cutting mechanism 400 which performs makeup cutting of the roll sheet etc. can be used. A known thing can be used as these mechanisms.

The example of the bookbinding method by the bookbinding machine 100 will be explained. At first, after performing duplex printing on the roll sheet 3 and cutting for every sheet of the bookbinding thing after bookbinding (for example, one image printing domain), as shown in FIG. 15(*a*), by the binding mechanism 300, the position of the cut roll sheets 82 are aligned and piled up and one side of the roll sheets 82 piled up is bound by the stapler 85. Next, by the cutting mechanism 400, the side which faces the bound side is cut at the cut line 89 and the photograph book 81 (bookbinding thing) is created. The roll sheets 82 can be bound by the mechanism 300 after cut by the cutting mechanism 400. And the binding mechanism 300 can perform binding one side by ring. Moreover, by the folding mechanism 200, the neighborhood of the bound side can be folded at the fold line 83, and this makes easy to open the photograph book after bookbinding. Moreover, the cutting mechanism 400 can cut plural sides of the roll sheets 82.

Moreover, as shown in FIG. 15(*b*), in the binding mechanism 300, one side of the piled-up roll sheets 82 can be bound by the bookbinding tape 87.

Moreover, in the binding mechanism 300, the roll sheets 82 can be bound using the cover 91 (including spine of cover) as shown in FIG. 16(*a*). As the cover 91, the roll sheet 3 printed by the printer for duplex printing 1 can be used, for example. This roll sheet 3 is cut by a length comprised of the width of two sheets (for example, two image printing domains) corresponding to the page of the beginning and last of a bookbinding thing and the width of spine of cover corresponding to the spine of a bookbinding thing. The width of the spine of cover can be the length that the thickness of paper (for example, 200 microns) multiplied by the number of sheets of the bookbinding thing is added about 2 to 5 mm. The length that the roll sheet 3 is cut can be controlled by a control part (un-illustrated). In addition, another paper can be used as the cover 91.

As shown in FIG. 16(*b*), the binding mechanism 300 pastes on the portion of the spine of cover 92 of the cover 91 and forms the paste part 95, and bonds and binds one side of the roll sheets 82 piled up at the paste part 95. As this paste, EVA system hot melt adhesives, polyurethane system adhesive, and acrylics system adhesives etc. can be used, for example. In this case, as shown in FIG. 16(*a*), (*b*), the folding mechanism 200 folds both sides of the spine of cover 92 as the fold line 93. In addition, the spine of cover 92 of the cover 91 can be bonded at the end of the piled-up roll sheets 82 pasted, and bound.

Moreover, on the spine of cover 92 of the cover 91 (roll sheet 3), as shown in FIG. 16(*c*), the printer for duplex printing 1 can beforehand print the title of a bookbinding thing etc., and as shown in FIG. 16(*d*), the end 96 to be pasted in the paste part 95 of the roll sheet 82 can be ground coarsely beforehand by a grinding mechanism (un-illustrated). Thereby, the adhesiveness in the paste part 95 of the roll sheets 82 increases.

Moreover, bookbinding can also be performed by folding the roll sheet 3 printed on both sides and cut for every two or more sheets of the bookbinding thing after bookbinding (for example, two or more continuous image printing domains).

The example of the bookbinding method in this case will be explained. At first, by the folding mechanism 200, as shown in FIG. 17(*a*), the roll sheet 101 cut is folded in the shape of bellows at the fold line of the mountain fold line 103*a* and the valley fold line 103*b*. Then, by the binding mechanism 300, as shown in FIG. 17(*b*), neighborhood of the mountain fold line 103*a* is pasted and the paste part 75 is formed, and as shown in FIG. 17(*c*), one side of the roll sheet 101 folded is bound by bonding the spine of cover 107 to the paste part 95. Furthermore, by the cutting mechanism 400, the side which faces the side bound in the roll sheet 101 folded (corresponding to the valley fold line 103*b*) is cut at the cut line 89 and a bookbinding thing is created. In this way, the bookbinding thing bound with the spine of cover 107 instead of the bookbinding tape 87 in FIG. 15(*b*) is obtained. Of course, stapler binding or ring binding can also be performed instead of using the spine of cover 107 and the paste part 95.

In the binding mechanism 300, as shown in FIG. 17(*d*), using the cover 91 (including spine of cover) mentioned above, the spine of the cover 91 can also be bonded and bound with the paste part 95 of the folded roll sheet 101. One side of the roll sheet 101 can also be bonded and bound with the spine of the cover 91 pasted. Furthermore, as shown in FIG. 17(*e*), binding can be performed as mentioned above with the bookbinding tape 87 having the adhesion part, or with piling the roll sheet (with length of one sheet of a bookbinding thing) independently printed as the cover 109 and the back cover 111. Moreover, same as mentioned above, the adhesiveness of the roll sheet 101 at the time of binding can be increased by grinding coarsely the end of the roll sheet 101 to be pasted.

When binding one side by the binding mechanism 300, or cutting the side faces that side by the cutting mechanism 400 and creating a bookbinding thing, in duplex printing on the roll sheet 3, it is desirable to provide blank space between image printing domains according to the size of the binding margin or the cut part cut by the cut line 89. For example, as shown in FIG. 18, blank space is provided at the portion which pasting etc. are performed at the time of bookbinding and serves as the binding margin 113, and the cut part 115 cut by the cut line 89 at the time of bookbinding. These can be determined beforehand to be controlled by a control part (un-illustrated). Moreover, the width of the binding margin 113 and the cut part 115 is not necessarily the same. Furthermore, instead of making binding margin 113 etc. to blank space, the printer for duplex printing 1. can print there in light colors, such as gray, at the time of the above-mentioned duplex printing. Thereby, when the page of bookbinding things, such as a photograph book, is opened, there is no conspicuous white portion.

As other bookbinding methods, as shown in FIG. 19(*a*), a bookbinding thing can also be created by providing the portion that the roll sheet 101 is folded at a short interval between the side bound at the time of bookbinding and the side which faces this when folding the roll sheet 101 by the folding mechanism 200, and binding one side and cutting the side facing this.

Or, as shown in FIG. 19(*b*), the roll sheet 101 which is cut by predetermined length and folded by the folding mechanism 200 to form the folded part between the side to be bound in a bookbinding thing and the side faces this can be piled and bound with the roll sheet 82 cut for every sheet of a bookbinding thing, and a bookbinding thing can also be created without cutting by the cutting mechanism 400.

Thus, as shown in FIG. 19(*c*), the photograph book 81 which lengthened a part of pages is created and outputted, and change can be given to bookbinding size. Printing one image on this lengthened page etc. can be performed. In addition, the method of giving change to bookbinding size is not restricted to these.

Furthermore, as shown in FIG. 19(*d*), the roll sheet cut for every two or more sheets of a bookbinding thing (for example, two or more continuous images printing domains) is folded in the shape of bellows by the folding mechanism 200 and bound between the sides of the folded roll sheet 101 (corresponding to the mountain fold line 103*a* and the valley fold line 103*b*) with a stapler 117 etc. by the binding mechanism 300, the side of the folded roll sheet 101 is cut by the cutting mechanism 400, the roll sheet 101 is folded further at the position bound with a stapler 117 etc. as the fold line 119 by the folding mechanism 200, and thereby the photograph book 81 as shown in FIG. 19(*e*) can be obtained.

Now, the above-mentioned printing procedure is controllable through the control part of the printer for duplex printing 1, and the control method can be defined by the maximum printing number of images which can be printed on one side at one conveyance etc.

The example of the printing control that a control part performs will be explained. In addition, this control method is applicable to the both bookbinding method which creates a photograph book of the leaf type which creates a bookbinding thing using the roll sheet 3 cut for every sheet of the bookbinding thing mentioned above, and of the continuous-sheets type which creates a bookbinding thing using the roll sheet 3 cut for every two or more sheets of a bookbinding thing. Moreover, a manual control and auto control can be performed.

For example, supposedly M images are printed in order to create a photograph book etc. and N images as maximum printing number of images can be printed on one side at one conveyance at this time. In this case, a control part calculates M/(2×N) and obtains the quotient A and the reminder B. From this, the printer for duplex printing 1 repeats duplex printing on the roll sheet 3 A times. Then, B images remained are printed. B images remained can be printed for every image on the 1st surface or 2nd surface of the roll sheet 3, for example.

This will be explained using a specific example. Supposedly 7 images of a, b, c, d, e, f, and g (memorized in the memory of a control part) in order of page are printed on the roll sheet 3, and the two images as maximum printing number of images can be printed on one side at one conveyance. At this time, the quotient A of M/(2×N) is 1, and the remainder B is 3.

The printing procedure at this time will be explained as follows. That is, after printing two images a and c on the 1st surface of the roll sheet 3 in this order at first, two images b and d are printed on the 2nd surface of the roll sheet 3 in this order. In this way, duplex printing is performed once (A=1), and three images e, f, and g remain (B=3). After that, images e, f, and g can be printed for every image on the 1st surface or 2nd surface of the roll sheet 3 in this order.

Since the maximum printing number of images which can be printed on one side at one conveyance is assumed to be two, B/2 is further calculated about B, the quotient C and the remain D is obtained, and thereby, in the case of C=1, D can be the number of images which is finally printed once on the 2nd surface of the roll sheet 3. In the case of C=0, D is the number of images finally printed once on the 1st surface. At this time, in the state that duplex printing is performed all if D is 0, and in the state that image of last one sheet on the 2nd surface of the roll sheet 3 is not printed if D is 1, the roll sheet 3 will be cut.

In addition, as control according to the bookbinding methods, such as a leaf type and a continuous-sheets type, for example, the order of printing images on the roll sheet 3 for example, the above-mentioned a, b, c, d, e, f, and g) can be controlled by rearranging beforehand according to the bookbinding method of a leaf type and continuous-sheets type, and above printing control according to the maximum printing number of images etc. can be performed henceforth similarly.

Suitable embodiments of the duplex printing method etc. of the present invention were explained above referring to accompanying figures, but the present invention is not limited to these examples. A person skilled in the art will be obviously able to create various kinds of examples of change or correction in the category of the technical idea indicated by this application, and these will be understood to be naturally belonged to the technical scope of the present invention.

EXPLANATION OF REFERENCES

1 . . . printer for duplex printing
3 . . . roll sheet
5 . . . cutter
7, 7*a*, 7*b* . . . thermal transfer sheet
9, 9*a*, 9*b* . . . thermal transfer sheet feed roll
10, 10*a*, 10*b* . . . thermal transfer sheet rolling-up roll
11, 11*a*, 11*b* . . . thermal head
13, 13*a*, 13*b* . . . platen roller
15, 15*a*, 15*b* . . . nip roller
17 . . . sensor
53*a*, 53*b*, 55 . . . clamp
100 . . . bookbinding machine

What is claimed is:

1. A duplex printing method for printing on both sides of a roll sheet by a thermal transfer method, comprising:

printing firstly, in such a manner that a surface of 1st thermal transfer sheet in which a color material layer is provided touches 1 st surface of the roll sheet and 2 nd surface of the roll sheet touches 1 st platen roller, superimposing and pressing the 1 st thermal transfer sheet and the roll sheet between the 1 st platen roller and 1 st thermal head, making the 1 st thermal head to generate heat according to image data while conveying the 1 st thermal transfer sheet and the roll sheet, transferring a color material of a color material layer of the 1st thermal transfer sheet to the 1st surface of the roll sheet, and printing image on the 1st surface of the roll sheet, and printing secondly, in such a manner that a surface of 2 nd thermal transfer sheet in which a color material layer is provided touches 2 nd surface of the roll sheet and 1st surface of the roll sheet touches 2 nd platen roller, superimposing and pressing the 2 nd thermal transfer sheet and the roll sheet between the 2 nd platen roller and 2 nd thermal head, making the 2 nd thermal head to generate heat according to image data while conveying the 2 nd thermal transfer sheet and the roll sheet, transferring a color material of a color material layer of the 2 nd thermal transfer sheet to the 2 nd surface of the roll sheet, and printing image on the 2 nd surface of the roll sheet, wherein performing control of duplex printing according to a maximum printing number of images which can be printed on one side at one conveyance by a control part.

2. A duplex printing method for printing on both sides of a roll sheet according to claim 1, comprising: when transferring a color material of a color material layer of a thermal transfer sheet to the roll sheet, performing conveyance of the roll sheet with nipping the roll sheet by the 1 st platen roller and 1 st nip roller and nipping the roll sheet by the 2 nd platen roller and 2 nd nip roller.

3. A duplex printing method for printing on both sides of a roll sheet according to claim 2, further comprising:

in printing firstly, while printing image on the 1 st surface of the roll sheet, forming a detection mark on the 1 st surface of the roll sheet, and in printing secondly, aligning a position of an image to be printed on the 2 nd surface of the roll sheet to a position of an image printed on the 1 st surface of the roll sheet in printing firstly by detecting the detection mark by a sensor.

4. A duplex printing method for printing on both sides of a roll sheet according to claim 2, further comprising:

in printing secondly, aligning a position of an image to be printed on the 2 nd surface of the roll sheet to a position of an image printed on the 1 st surface of the roll sheet in printing firstly by detecting a tip of the roll sheet by a sensor.

5. A printer for use in a duplex printing method according to claim 1.

6. A duplex printing method for printing on both sides of a roll sheet by a thermal transfer method, comprising:

printing firstly, in such a manner that a surface of a thermal transfer sheet in which a color material layer is provided touches 1st surface of the roll sheet and 2 nd surface of the roll sheet touches a platen roller, superimposing and pressing the thermal transfer sheet and the roll sheet between the platen roller and a thermal head, making the thermal head to generate heat according to image data while conveying the thermal transfer sheet and the roll sheet, transferring a color material of a color material layer of the thermal transfer sheet to the 1 st surface of the roll sheet, and printing image on the 1 st surface of the roll sheet, conveying, pulling back the roll sheet from the platen roller, changing a conveyance course of the roll sheet and conveying the roll sheet toward the platen roller so that the platen roller touches the 1 st surface of the roll sheet, and printing secondly, in such a manner that a surface of the thermal transfer sheet in which a color material layer is provided touches the 2nd surface of the roll sheet and the 1 st surface of the roll sheet touches a platen roller, superimposing and pressing the thermal transfer sheet and the roll sheet between the platen roller and the thermal head, making the thermal head to generate heat according to image data while conveying the thermal transfer sheet and the roll sheet, transferring a color material of a color material layer of the thermal transfer sheet to the 2 nd surface of the roll sheet, and printing image on the 2 nd surface of the roll sheet.

7. A duplex printing method for printing on both sides of a roll sheet according to claim 6, further comprising: when transferring a color material of a color material layer of the thermal transfer sheet to the roll sheet, performing conveyance of the roll sheet with nipping the roll sheet by the platen roller and a nip roller.

8. A duplex printing method for printing on both sides of a roll sheet according to claim 7, further comprising:

in printing firstly, while printing image on the 1 st surface of the roll sheet, forming a detection mark on the 1 st surface of the roll sheet, and in printing secondly, aligning a position of an image to be printed on the 2 nd surface of the roll sheet to a position of an image printed on the 1 st surface of the roll sheet in printing firstly by detecting the detection mark by a sensor.

9. A duplex printing method for printing on both sides of a roll sheet according to claim 7, further comprising:

in printing secondly, aligning a position of an image to be printed on the 2 nd surface of the roll sheet to a position of an image printed on the 1 st surface of the roll sheet in printing firstly by detecting a tip of the roll sheet by a sensor.

10. A duplex printing method for printing on both sides of a roll sheet according to claim 6, further comprising: when transferring a color material of a color material layer of the thermal transfer sheet to the roll sheet, performing conveyance of the roll sheet with nipping the roll sheet by the platen roller and a clamp.

11. A duplex printing method for printing on both sides of a roll sheet according to claim 6, further comprising: when transferring a color material of a color material layer of the thermal transfer sheet to the roll sheet, performing conveyance of the roll sheet with nipping the roll sheet by a conveyance course and a clamp.

12. A duplex printing method for printing on both sides of a roll sheet according to claim 6, further comprising: when transferring a color material of a color material layer of the thermal transfer sheet to the roll sheet, performing conveyance of the roll sheet with nipping the roll sheet by the platen roller and a clamp until predetermined conveyance length, and over predetermined conveyance length, performing conveyance of the roll sheet with nipping the roll sheet by a conveyance course and a clamp.

13. A duplex printing method for printing on both sides of a roll sheet according to claim 6, wherein performing control of duplex printing according to a maximum printing number of images which can be printed on one side at one conveyance by a control part.

14. A bookbinding method, comprising bookbinding, performing bookbinding using a roll sheet printed by a duplex printing method according to claim 6.

15. A bookbinding method according to claim 14, wherein, in bookbinding, piling roll sheets cut for every sheet of a bookbinding thing and binding at one side of them, and creating a bookbinding thing.

16. A bookbinding method according to claim 15, wherein grinding an end part of the roll sheet corresponding to the one side to be bound coarsely.

17. A bookbinding method according to claim 14, wherein, in bookbinding, folding a roll sheet cut for every two or more sheets of a bookbinding thing, binding at one side of it, cutting a side which faces the one side bound, and creating a bookbinding thing.

18. A bookbinding method according to claim 17, wherein grinding an end part of the roll sheet corresponding to the one side to be bound coarsely.

19. A bookbinding method according to claim 17, wherein, when folding the roll sheet, between the one side to be bound and a side which faces this, a portion which folds the roll sheet at a short interval is provided.

20. A bookbinding method according to claim 14, wherein, in bookbinding, piling and binding a roll sheet cut for every sheet of a bookbinding thing with a roll sheet cut by predetermined length and folded so that a portion which is folded is formed between a side to be bound in a bookbinding thing and a side which faces this.

21. A bookbinding method according to claim 14, wherein, in bookbinding, folding a roll sheet cut for every two or more sheets of a bookbinding thing and binding between sides folded, cutting a side folded, and folding a bound position further.

22. A printer for use in a duplex printing method according to claim 6.

23. A duplex printing method for printing on both sides of a roll sheet by a thermal transfer method, comprising:

printing firstly, in such a manner that a surface of 1 st thermal transfer sheet in which a color material layer is provided touches 1 st surface of the roll sheet and 2 nd surface of the roll sheet touches a platen roller, superimposing and pressing the 1 st thermal transfer sheet and the roll sheet between the platen roller and 1 st thermal head, making the 1 st thermal head to generate heat according to image data while conveying the 1st thermal transfer sheet and the roll sheet, transferring a color material of a color material layer of the 1 st thermal transfer sheet to the 1 st surface of the roll sheet, and printing image on the 1 st surface of the roll sheet, conveying, pulling back the roll sheet from the platen roller, changing a conveyance course of the roll sheet and conveying the roll sheet toward the platen roller so that the platen roller touches the 1st surface of the roll sheet, and printing secondly, in such a manner that a surface of 2 nd thermal transfer sheet in which a color material layer is provided touches the 2 nd surface of the roll sheet and the 1 st surface of the roll sheet touches a platen roller, superimposing and pressing the 2 nd thermal transfer sheet and the roll sheet between the platen roller and 2 nd thermal head, making the 2 nd thermal head to generate heat according to image data while conveying the 2 nd thermal transfer sheet and the roll sheet, transferring a color material of a color material layer of the 2 nd thermal transfer sheet to the 2nd surface of the roll sheet, and printing image on the 2 nd surface of the roll sheet, wherein performing control of duplex printing according to a maximum printing number of images which can be printed on one side at one conveyance by a control part.

24. A duplex printing method for printing on both sides of a roll sheet according to claim 23, wherein, when transferring a color material of a color material layer of the 1 st or 2 nd thermal transfer sheet to the roll sheet, performing conveyance of the roll sheet with nipping the roll sheet by the platen roller and a nip roller.

25. A duplex printing method for printing on both sides of a roll sheet according to claim 23, wherein, when transferring a color material of a color material layer of the 1 st or 2 nd thermal transfer sheet to the roll sheet, performing conveyance of the roll sheet with nipping the roll sheet by a platen roller and a clamp.

26. A duplex printing method for printing on both sides of a roll sheet according to claim 23, wherein, in printing firstly, while printing image on the 1 st surface of the roll sheet, forming a detection mark on the 1 st surface of the roll sheet, and in printing secondly, when transferring a color material of a color material layer of the 2 nd thermal transfer sheet to the roll sheet, performing conveyance of the roll sheet with nipping the roll sheet by the platen roller and a nip roller, and aligning a position of an image to be printed on the 2 nd surface of the roll sheet to a position of an image printed on the 1 st surface of the roll sheet in printing firstly by detecting the detection mark by a sensor.

27. A duplex printing method for printing on both sides of a roll sheet according to claim 23, wherein, in printing secondly, when transferring a color material of a color material layer of the 2 nd thermal transfer sheet to the roll sheet, performing conveyance of the roll sheet with nipping the roll sheet by the platen roller and a nip roller, and aligning a position of an image to be printed on the 2 nd surface of the roll sheet to a position of an image printed on the 1 st surface of the roll sheet in printing firstly by detecting a tip of the roll sheet by a sensor.

28. A bookbinding method, comprising:

bookbinding, and performing bookbinding using a roll sheet printed by a duplex printing method, the duplex printing method comprising:

printing firstly, in such a manner that a surface of 1 st thermal transfer sheet in which a color material layer is provided touches 1 st surface of the roll sheet and 2 nd surface of the roll sheet touches 1 st platen roller, superimposing and pressing the 1 st thermal transfer sheet and the roll sheet between the 1 st platen roller and 1 st thermal head, making the 1 st thermal head to generate heat according to image data while conveying the 1 st thermal transfer sheet and the roll sheet, transferring a color material of a color material layer of the 1 st thermal transfer sheet to the 1st surface of the roll sheet, and printing image on the 1 st surface of the roll sheet, and printing secondly, in such a manner that a surface of 2 nd thermal transfer sheet in which a color material layer is provided touches 2 nd surface of the roll sheet and 1 st surface of the roll sheet touches 2 nd platen roller, superimposing and pressing the 2 nd thermal transfer sheet and the roll sheet between the 2 nd platen roller and 2 nd thermal head, making the 2 nd thermal head to generate heat according to image data while conveying the 2 nd thermal transfer sheet and the roll sheet, transferring a color material of a color material layer of the 2 nd thermal transfer sheet to the 2 nd surface of the roll sheet, and printing image on the 2 nd surface of the roll sheet.

29. A bookbinding method according to claim 28, further comprising: in bookbinding, piling roll sheets cut for every sheet of a bookbinding thing and binding at one side of them, and creating a bookbinding thing.

30. A bookbinding method according to claim 29, further comprising: grinding an end part of the roll sheet corresponding to the one side to be bound coarsely.

31. A bookbinding method according to claim 28, further comprising: in bookbinding, folding a roll sheet cut for every two or more sheets of a bookbinding thing, binding at one side of it, cutting a side which faces the one side bound, and creating a bookbinding thing.

32. A bookbinding method according to claim 31, further comprising: grinding an end part of the roll sheet corresponding to the one side to be bound coarsely.

33. A bookbinding method according to claim 31, when folding the roll sheet, between the one side to be bound and a side which faces the one side, a portion which folds the roll sheet at a short interval is provided.

34. A bookbinding method according to claim 28, further comprising: in bookbinding, piling and binding a roll sheet cut for every sheet of a bookbinding thing with a roll sheet cut by predetermined length and folded so that a portion which is folded is formed between a side to be bound in a bookbinding thing and a side which faces the side to be bound in the bookbinding thing.

35. A bookbinding method according to claim 28, further comprising: in bookbinding, folding a roll sheet cut for every two or more sheets of a bookbinding thing and binding between sides folded, cutting a side folded, and folding a bound position further.

36. A bookbinding method according to claim 28, the duplex printing method further comprising:

when transferring a color material of a color material layer of the thermal transfer sheet to the roll sheet, performing conveyance of the roll sheet with nipping the roll sheet by the 1 st platen roller and 1 st nip roller and nipping the roll sheet by the 2 nd platen roller and 2 nd nip roller.

37. A bookbinding method according to claim 28, the duplex printing method further comprising:

in printing firstly, while printing image on the 1 st surface of the roll sheet, forming a detection mark on the 1 st surface of the roll sheet, and in printing secondly, aligning a position of an image to be printed on the 2 nd surface of the roll sheet to a position of an image printed on the 1 st surface of the roll sheet in printing firstly by detecting the detection mark by a sensor.

38. A bookbinding method according to claim 28, the duplex printing method further comprising:

in printing secondly, aligning a position of an image to be printed on the 2 nd surface of the roll sheet to a position of an image printed on the 1 st surface of the roll sheet in printing firstly by detecting a tip of the roll sheet by a sensor.

39. A bookbinding method, comprising:

bookbinding, and performing bookbinding using a roll sheet printed by a duplex printing method, the duplex printing method comprising:

printing firstly, in such a manner that a surface of 1 st thermal transfer sheet in which a color material layer is provided touches 1 st surface of the roll sheet and 2 nd surface of the roll sheet touches a platen roller, superimposing and pressing the 1 st thermal transfer sheet and the roll sheet between the platen roller and 1 st thermal head, making the 1 st thermal head to generate heat according to image data while conveying the 1 st thermal transfer sheet and the roll sheet, transferring a color material of a color material layer of the 1 st thermal transfer sheet to the 1 st surface of the roll sheet, and printing image on the 1 st surface of the roll sheet, conveying, pulling back the roll sheet from the platen roller, changing a conveyance course of the roll sheet and conveying the roll sheet toward the platen roller so that the platen roller touches the 1 st surface of the roll sheet, and printing secondly, in such a manner that a surface of 2 nd thermal transfer sheet in which a color material layer is provided touches the 2 nd surface of the roll sheet and the 1 st surface of the roll sheet touches a platen roller, superimposing and pressing the 2 nd thermal transfer sheet and the roll sheet between the platen roller and 2 nd thermal head, making the 2 nd thermal head to generate heat according to image data while conveying the 2 nd thermal transfer sheet and the roll sheet, transferring a color material of a color material layer of the 2 nd thermal transfer sheet to the 2 nd surface of the roll sheet, and printing image on the 2 nd surface of the roll sheet.

* * * * *